US006203347B1

(12) United States Patent
Crane, Jr.

(10) Patent No.: US 6,203,347 B1
(45) Date of Patent: Mar. 20, 2001

(54) HIGH-DENSITY ELECTRICAL INTERCONNECT SYSTEM

(75) Inventor: Stanford W. Crane, Jr., Boca Raton, FL (US)

(73) Assignee: Silicon Bandwidth Inc., Fremont, CA (US)

( * ) Notice: Subject to any disclaimer, the term of this patent is extended or adjusted under 35 U.S.C. 154(b) by 0 days.

(21) Appl. No.: 09/407,955

(22) Filed: Sep. 28, 1999

Related U.S. Application Data

(63) Continuation of application No. 08/744,377, filed on Nov. 7, 1996, now Pat. No. 5,967,850, which is a continuation of application No. 08/381,142, filed on Jan. 31, 1995, now Pat. No. 5,575,688, which is a continuation of application No. 07/983,083, filed on Dec. 1, 1992, now abandoned.

(51) Int. Cl.[7] ..... H01R 11/22
(52) U.S. Cl. ..... 439/268
(58) Field of Search ..... 439/260, 263, 439/268, 660

(56) References Cited

U.S. PATENT DOCUMENTS

| | | | |
|---|---|---|---|
| 3,337,838 | 8/1967 | Damiano et al. | 339/217 |
| 3,366,915 | 1/1968 | Miller | 339/49 |

(List continued on next page.)

FOREIGN PATENT DOCUMENTS

| | | |
|---|---|---|
| 3737819 A1 | 5/1988 | (DE) . |
| 0 321 212 | 6/1989 | (EP) . |
| 0 405 454 A2 | 1/1991 | (EP) . |
| 0 467 698 | 1/1992 | (EP) . |
| 1129608 | 10/1968 | (GB) . |
| WO 94/13034 | 6/1994 | (WO) . |
| WO 94/27345 | 11/1994 | (WO) . |

OTHER PUBLICATIONS

AMP Product Guide, Printed Circuited Board Connectors 3, pp. 3008, 3067–3068, 3102–3103, 3122–3123.

George D. Gregoire, "3–Dimensional Circuitry Solves Fine Pitch SMT Device Assembly Problem;" Connection Technology.

Dimensional Circuits Corporation, "Dimensional Circuits Corp. Awarded Two U.S. Patents," D.C.C. News, Apr. 5, 1994.

George D. Gregoire, "Very Fine Line Recessed Circuitry—A New PCB Fabrication Process".

Robert Barnhouse, "Bifurcated Through–Hole Technology—An Innovative Solution to Circuit Density," Connection Technology, pp. 33–35 (Feb., 1992).

(List continued on next page.)

*Primary Examiner*—Neil Abrams
(74) *Attorney, Agent, or Firm*—Morgan, Lewis & Bockius LLP

(57) ABSTRACT

An electrical connector includes a projection-type interconnect component and a receiving type interconnect component. The projection-type interconnect component includes an insulative buttress and a plurality of electrically conductive contacts. The contacts are spaced from each other around a circumference of the insulative buttress. The receiving-type interconnect component is adapted for receiving the projection-type interconnect component. The receiving-type interconnect component includes a plurality of flexible, electrically conductive contacts and a spacer movable relative to the flexible contacts. The spacer at least partially flexes the flexible contacts when the spacer is in a first position. The insulative buttress of the projection-type interconnect component displaces the spacer of the receiving-type interconnect component when the projection-type interconnect component is received by the receiving-type interconnect component.

23 Claims, 38 Drawing Sheets

U.S. PATENT DOCUMENTS

| | | | | |
|---|---|---|---|---|
| 3,444,506 | | 5/1969 | Wedekind | 339/99 |
| 3,848,221 | | 11/1974 | Lee, Jr. | 339/74 R |
| 4,274,700 | | 6/1981 | Keglewitsch et al. | 339/192 R |
| 4,373,764 | * | 2/1983 | Ulrich | 439/263 |
| 4,487,463 | | 12/1984 | Tillotson | 339/17 C |
| 4,572,604 | | 2/1986 | Ammon et al. | 339/176 MP |
| 4,616,406 | | 10/1986 | Brown | 29/588 |
| 4,654,472 | | 3/1987 | Goldfarb | 174/52 R |
| 4,655,526 | | 4/1987 | Shaffer | 339/74 R |
| 4,698,663 | | 10/1987 | Sugimoto et al. | 357/81 |
| 4,734,042 | | 3/1988 | Martens et al. | 439/62 |
| 4,897,055 | | 1/1990 | Jurista et al. | 439/924 |
| 4,943,846 | | 7/1990 | Shirling | 357/80 |
| 4,959,750 | | 9/1990 | Cnyrim et al. | 361/401 |
| 4,975,066 | | 12/1990 | Sucheski et al. | 439/63 |
| 4,997,376 | | 3/1991 | Buck et al. | 439/59 |
| 5,015,207 | | 5/1991 | Koepke | 439/886 |
| 5,037,311 | | 8/1991 | Frankeny et al. | 439/66 |
| 5,071,363 | | 12/1991 | Reylek et al. | 439/291 |
| 5,081,563 | | 1/1992 | Feng et al. | 361/414 |
| 5,117,069 | | 5/1992 | Higgins, III | 174/261 |
| 5,123,164 | | 6/1992 | Shaheen et al. | 29/852 |
| 5,137,456 | | 8/1992 | Desai et al. | 439/66 |
| 5,140,659 | * | 8/1992 | Minds | 439/577 |
| 5,281,151 | | 1/1994 | Arima et al. | 439/68 |
| 5,309,024 | | 5/1994 | Hirano | 257/773 |
| 5,326,936 | | 7/1994 | Taniuchi et al. | 174/260 |
| 5,330,372 | | 7/1994 | Pope et al. | 439/692 |
| 5,334,279 | | 8/1994 | Gregoire | 156/630 |
| 5,342,999 | | 8/1994 | Frei et al. | 174/266 |
| 5,351,393 | | 10/1994 | Gregoire | 29/835 |
| 5,371,404 | | 12/1994 | Juskey et al. | 257/659 |
| 5,376,825 | | 12/1994 | Tukamoto et al. | 257/685 |
| 5,390,412 | | 2/1995 | Gregoire | 29/848 |

OTHER PUBLICATIONS

AMP Product Information Bulletin, "AMP–ASC Interconnection Systems," pp. 1–4 (1991).

AMP Product Guide, "Micro–Strip Interconnection System," pp. 3413–3414 (Jun., 1991).

Du Pont Connector Systems Product Catalog A, "Rib–Cage II Through–Mount Shrouded Headers" and "Micropax Board–to–board Interconnect System," pp. 2–6, 3–0, 3–1 (Feb., 1992).

R.R. Tummala et al., "Microelectronics Packaging Handbook," Van Nostrand Reinhold, 1989, pp. 38–43, 398–403, 779–791, 853–859, and 900–905.

Intel Corporation, "Packing," pp. 2–36, 2–96, 2–97, 2–100, 3–2, 3–24, and 3–25; (1993).

* cited by examiner

HIGH-DENSITY ELECTRICAL INTERCONNECT SYSTEM

This is a continuation of application Ser. No. 08/744,377 filed on Nov. 7, 1996, now U.S. Pat. No. 5,967,850; which is a continuation of application Ser. No. 08/381,142 filed on Jan. 31, 1995, now U.S. Pat. No. 5,575,688; which is a continuation of application Ser. No. 07/983,083 filed on Dec. 1, 1992, now abandoned.

I. BACKGROUND OF THE INVENTION

A. Field of the Invention

The present invention relates to a plug-in electrical interconnect system and, in particular, to interconnect component used in the plug-in electrical interconnect system. Although the electrical interconnect system of the present invention is particularly suitable for use in connection with high-density systems, it may also be used with high-power systems or other systems.

B. Description of the Related Art

Electrical interconnect systems (including electronic interconnect systems) are used for interconnecting electrical and electronic systems and components. In general, electrical interconnect systems contain both a projection-type interconnect component, such as a conductive pin, and a receiving-type interconnect component, such as a conductive socket. In these types of electrical interconnect systems, electrical interconnection is accomplished by inserting the projection-type interconnect component into the receiving-type interconnect component. Such insertion brings the conductive portions of the projection-type and receiving-type interconnect components into contact with each other so that electrical signals may be transmitted through the interconnect components. In a typical interconnect system (e.g., the pin grid array of FIG. 29, discussed in detail below), a plurality of individual conductive pins 101 are positioned in a grid formation and a plurality of individual conductive sockets (not shown in FIG. 29) are arranged to receive the individual pins, with each pin and socket pair transmitting a different electrical signal.

High-density electrical interconnect systems are characterized by the inclusion of a large number of interconnect component contacts within a small area. By definition, high-density electrical interconnect systems take up less space and include shorter signal paths than lower-density interconnect systems. The short signals paths associated with high-density interconnect systems allow such systems to transmit electrical signals at higher speeds. In general, the higher the density of an electrical interconnect system, the better the system.

Various attempts have been made in the past at producing an electrical interconnect system having a suitably high density. One electrical interconnect system that has been proposed is shown in FIG. 1(*a*).

The electrical interconnect system of FIG. 1(*a*) is known as a post and box interconnect system. In the system of FIG. 1(*a*), the projection-type interconnect component is a conductive pin or post 101, and the receiving-type interconnect component is a box-shaped conductive socket 102. FIG. 1(*b*) is a top view of the interconnect system of FIG. 1(*a*) showing the post 101 received within the socket 102. As can be seen from FIG. 1(*b*), the inner walls of the socket 102 include sections 103 and 104 which protrude inwardly to allow a tight fit of the post 101 within the socket. FIGS. 1(*a*) and 1(*b*) are collectively referred to herein as "FIG. 1."

Another electrical interconnect system that has been proposed is illustrated in FIG. 2(*a*). The electrical interconnect system of FIG. 2(*a*) is known as a single beam interconnect system. In the system of FIG. 2(*a*), the projection-type interconnect component is a conductive pin or post 201, and the receiving-type interconnect component is a conductive, flexible beam 202. FIG. 2(*b*) is a top view of the interconnect system of FIG. 2(*a*) showing the post 201 positioned in contact with flexible beam 202. The flexible beam 202 is biased against the post 201 to maintain contact between the flexible beam and the post. FIGS. 2(*a*) and 2(*b*) are collectively referred to herein as "FIG. 2."

A third electrical interconnect system that has been proposed is shown in FIG. 3(*a*). The electrical interconnect system shown in FIG. 3(*a*) is known as an edge connector system. The projection-type interconnect component of the edge connector system includes an insulative printed wiring board 300 and conductive patterns 301 formed on the upper and/or lower surfaces of the printed wiring board. The receiving-type interconnect component of the edge connector system includes a set of upper and lower conductive fingers 302 between which the printed wiring board 300 may be inserted.

FIG. 3(*b*) is a side view of the system illustrated in FIG. 3(*a*) showing the printed wiring board 300 inserted between the upper and lower conductive fingers 302. When the printed wiring board 300 is inserted between the conductive fingers, each conductive pattern 301 contacts a corresponding conductive finger 302 so that signals may be transmitted between the conductive patterns and the conductive fingers. FIGS. 3(*a*) and 3(*b*) are collectively referred to herein as "FIG. 3."

A fourth electrical interconnect system that has been proposed is shown in FIG. 4. The electrical interconnect system shown in FIG. 4 is known as a pin and socket interconnect system. In the system of FIG. 4, the projection-type interconnect component is a conductive, stamped pin 401, and the receiving-type interconnect component is a conductive, slotted socket 402. The socket 402 is typically mounted within a through-hole formed in a printed wiring board. The pin 401 is oversized as compared to the space within the socket 402. The size differential between the pin 401 and the space within the socket 402 is intended to allow the pin to fit tightly within the socket.

The interconnect systems of FIGS. 1 through 4 are deficient for a variety of reasons. For example, the interconnect components in these systems generally include plating on each external and internal surface to ensure adequate electrical contact between the projection-type and receiving-type components. Since plating is typically accomplished using gold or other expensive metals, the systems of FIGS. 1 through 4 can be quite costly to manufacture.

Performance-wise, the edge connector system of FIG. 3 is subject to capacitance problems and electromagnetic interference. Likewise, the pin and socket system of FIG. 4 requires a high insertion force to insert the pin 401 within the slotted socket 402, and will not fit together properly in the absence of near-perfect tolerancing.

The main problem associated with the systems of FIGS. 1 and 2 (when arranged, for example, as in FIG. 29), the system of FIG. 3 (when arranged, for example, in a pair of rows), and the system of FIG. 4 (when arranged, for example, as in FIG. 3(*a*)) is that these systems are not high enough in density to meet the needs of existing and/or future semiconductor and computer technology. Interconnect system density has already failed to keep pace with semiconductor technology, and as computer and microprocessor speeds continue to climb, with space efficiency becoming increasingly important, electrical interconnect systems having even higher densities will be required. The electrical interconnect systems discussed above fall short of current and contemplated interconnect density requirements.

II. SUMMARY OF THE INVENTION

Accordingly, it is a goal of the present invention to provide a high-density electrical interconnect system capable of meeting the needs of existing and contemplated computer and semiconductor technology.

Another goal of the present invention is to provide an electrical interconnect system that is less costly and more efficient than existing high-density electrical interconnect systems.

These and other goals may be achieved by using an electrical interconnect system that includes a plurality of projection-type interconnect components arranged in a nested configuration that yields a high density, adequate mating clearances, high reliability, and ease of manufacture.

In particular, the foregoing goals may be achieved by an electrical interconnect system comprising an insulative substrate; a plurality of groups of electrically conductive contacts arranged on the substrate, each of the contacts being electrically isolated from one another, and the groups being interleaved among one another in a nested configuration; and a plurality of receiving-type interconnect components each for receiving one of the groups of contacts within that component, wherein the nested configuration of the groups of contacts maintains the contacts in close proximity to one another while allowing adequate clearance between the contacts so that each group may be received within one of the receiving-type interconnect components.

It is to be understood that both the foregoing general description and the following detailed description are exemplary and explanatory, and are not restrictive of the invention as claimed. The accompanying drawings, which are incorporated in and constitute a part of the specification, illustrate embodiments of the present invention and together with the general description, serve to explain the principles of the present invention.

III. BRIEF DESCRIPTION OF THE DRAWINGS

FIG. 1(*b*) is a top view of the electrical interconnect system shown in FIG. 1(*a*).

FIG. 2(*b*) is a top view of the electrical interconnect system shown in FIG. 2(*a*).

FIG. 3(*b*) is a side view of the electrical interconnect system shown in FIG. 3(*a*).

FIG. 5(*b*) is a side view of a buttress portion of the projection-type interconnect component shown in FIG. 5(*a*).

FIG. 5(*c*) is a side view of two projection-type interconnect components in accordance with the embodiment of the present invention shown in FIG. 5(*a*).

FIG. 11(*b*) is a diagram showing patterns associated with the foot portions of alternating projection-type electrical interconnect components.

FIG. 13(*b*) is a perspective view of a projection-type electrical interconnect component in accordance the embodiment of FIG. 5(*a*) and a projection-type interconnect component in accordance with still another embodiment of the present invention.

FIG. 13(*c*) is a perspective view of a portion of one of the a projection-type electrical interconnect components shown in FIG. 13(*b*) with the tip portion of the component removed.

FIG. 16(*b*) is a perspective view of an interconnect system including plurality of flexible beams arranged to interface with a wire or cable.

FIG. 23(*b*) is a perspective view of the zero-insertion force component of FIG. 23(*a*) in a second state.

FIG. 24(*b*) is a perspective view of the zero-insertion force component of FIG. 24(*a*) in a second state.

FIG. 25(*b*) is a perspective view of the zero-insertion force component of FIG. 25(*a*) in a second state.

FIG. 26(*b*) is a perspective view of an interconnect system including the interconnect component of FIG. 12 in the mated condition.

FIG. 27(*b*) is a perspective view of another interconnect system including the interconnect component of FIG. 13(*a*) in a position prior to mating.

FIG. 28(*b*) is a perspective view of another electrical interconnect system showing insulative electrical carriers functioning as the substrates for the system.

FIG. 33(*b*) is a side view of a conductive post having an offset foot portion.

IV. DESCRIPTION OF THE PREFERRED EMBODIMENTS

A. General Description

The electrical interconnect system of the present invention includes a plurality of conductive posts arranged in groups, with each group being interleaved or nested within other groups of posts of the electrical interconnect system to form an interleaved or nested arrangement of the groups of contacts. Each group of conductive posts constitutes the conductive section of a projection-type interconnect component that is configured for receipt within a receiving-type interconnect component which includes a plurality of conductive beams. The conductive beams mate with the conductive posts when the projection-type interconnect component is received within the receiving-type interconnect component.

B. The Projection-Type Interconnect Component

The projection-type interconnect component of the present invention includes several electrically conductive posts attached to an electrically insulative substrate. The projection-type interconnect component may also include an electrically insulative buttress around which the conductive posts are positioned. The substrate and the buttress insulate the conductive posts from one another so that a different electrical signal may be transmitted on each post.

Figure 1A:
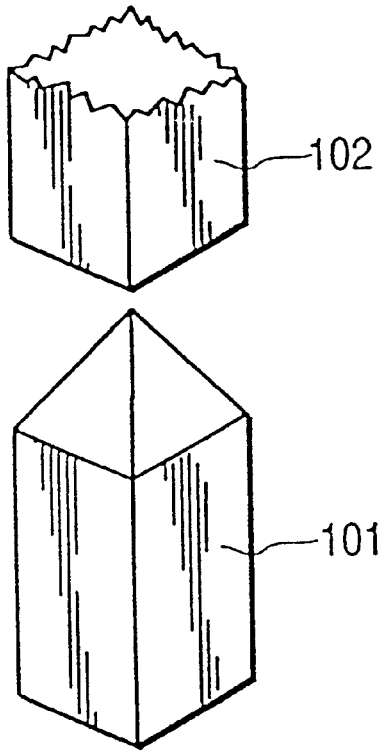
FIG. 1(a) PRIOR ART
FIG. 1(*a*) is a perspective view illustrating a prior art electrical interconnect system.
Figure 1B:
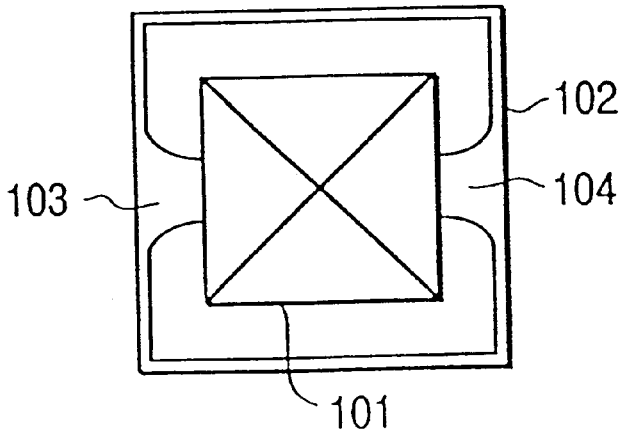
FIG. 1(b) PRIOR ART
Figure 2A:
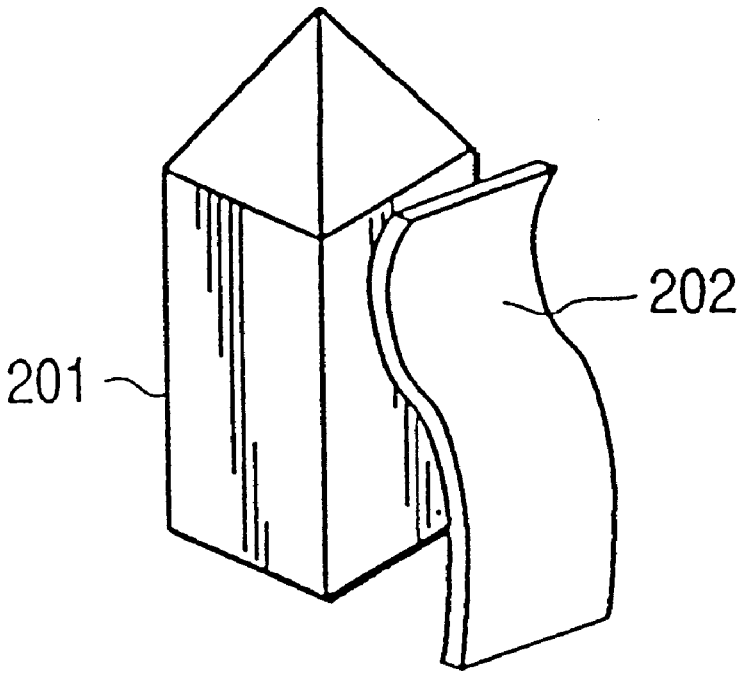
FIG. 2(a) PRIOR ART
FIG. 2(*a*) is a perspective view illustrating another prior art electrical interconnect system.
Figure 2B:
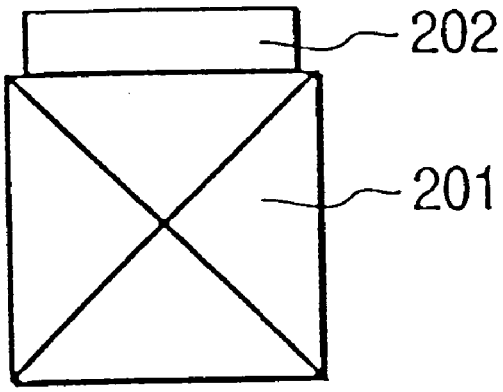
FIG. 2(b) PRIOR ART
Figure 3A:
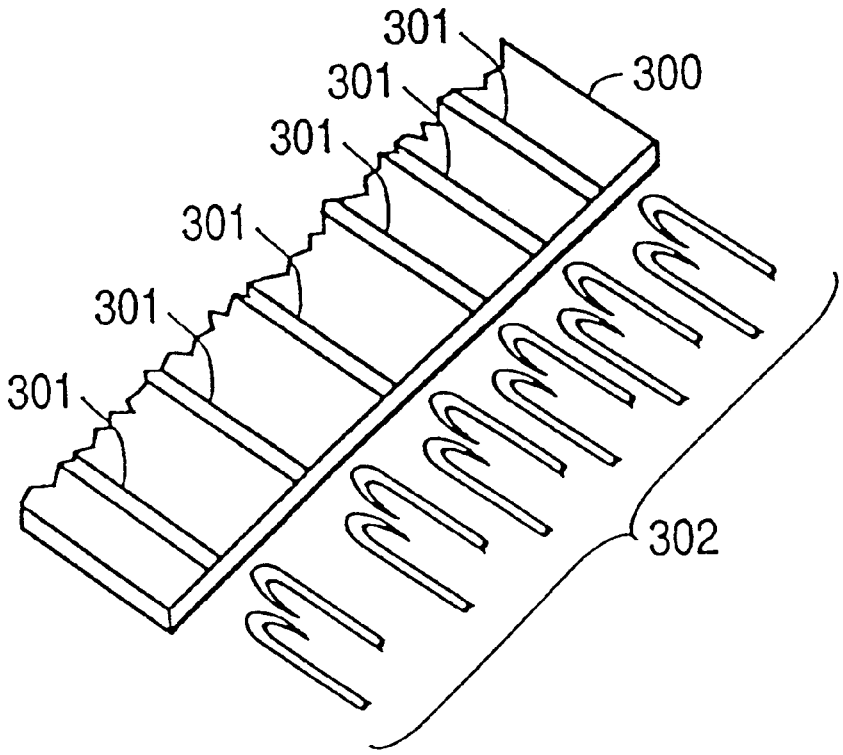
FIG. 3(a) PRIOR ART
FIG. 3(*a*) is a perspective view illustrating yet another prior art electrical interconnect system.
Figure 3B:
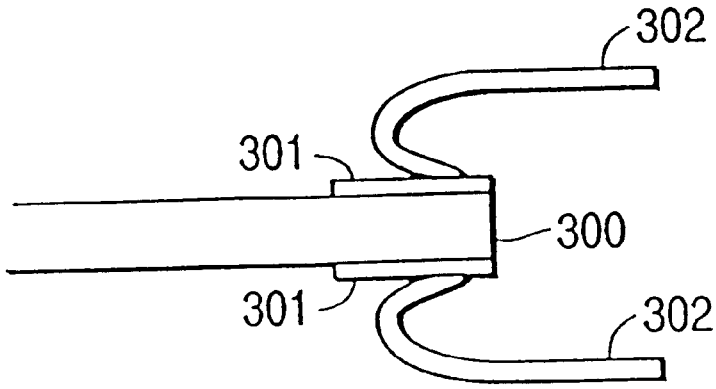
FIG. 3(b) PRIOR ART
Figure 4:
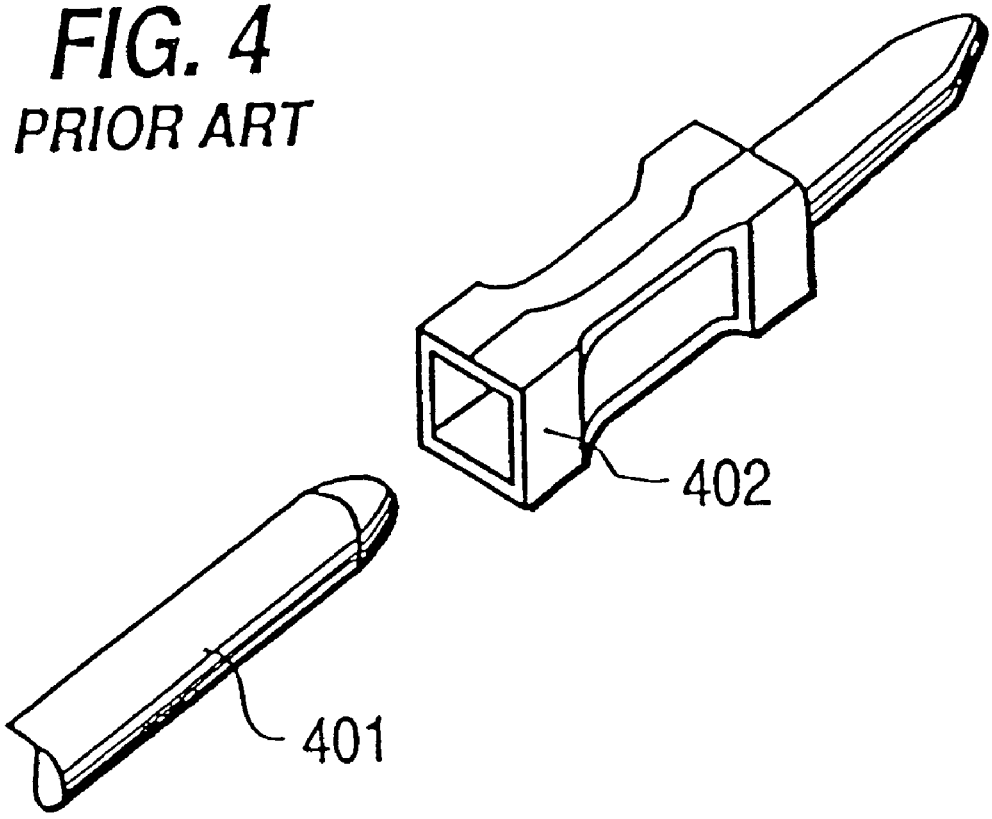
FIG. 4 PRIOR ART
FIG. 4 is a perspective view illustrating still another prior art electrical interconnect system.
Figure 5A:
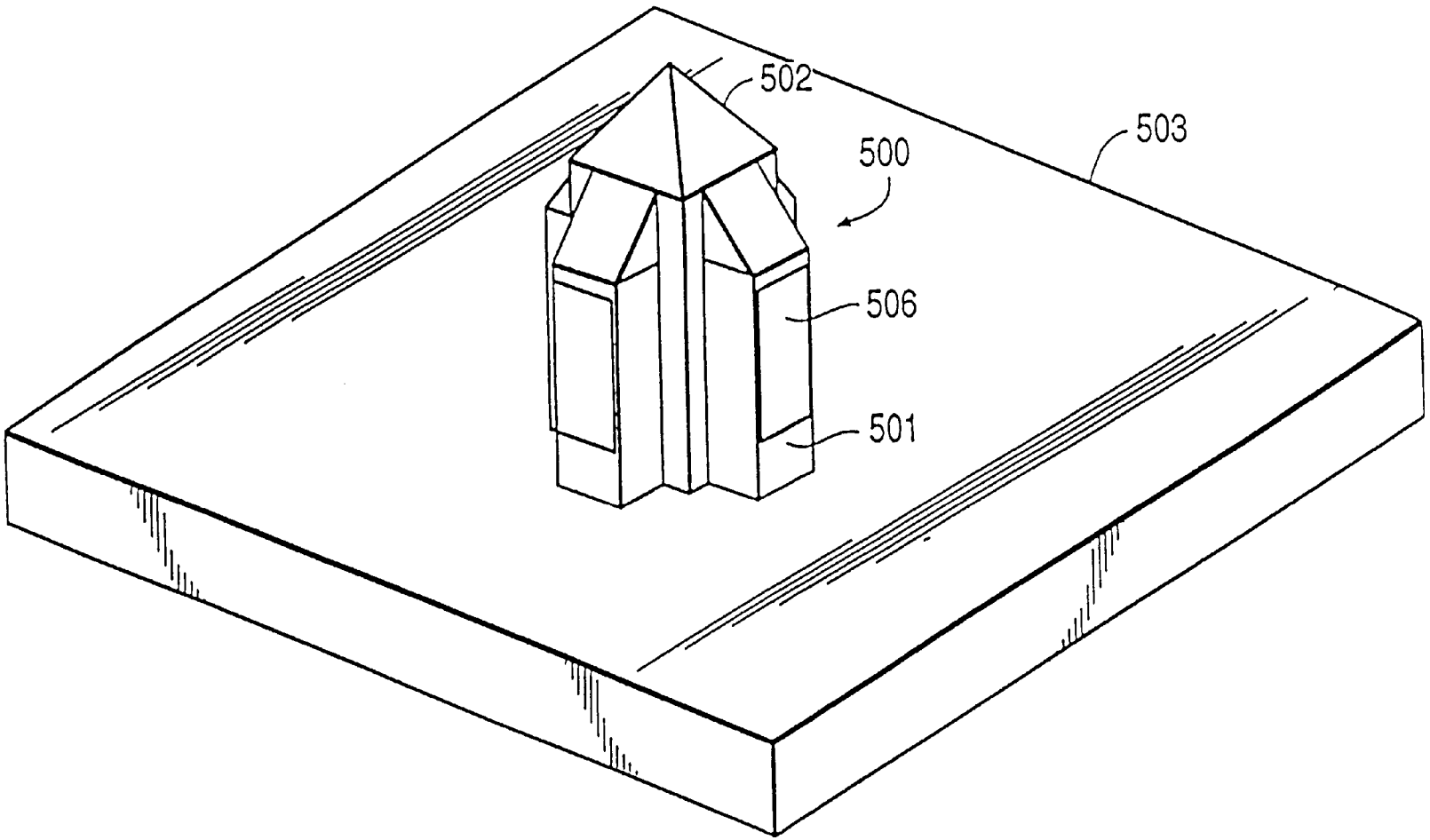
FIG. 5(*a*) is a perspective view of a portion of a projection-type interconnect component in accordance with an embodiment of the present invention.
Figure 5B:
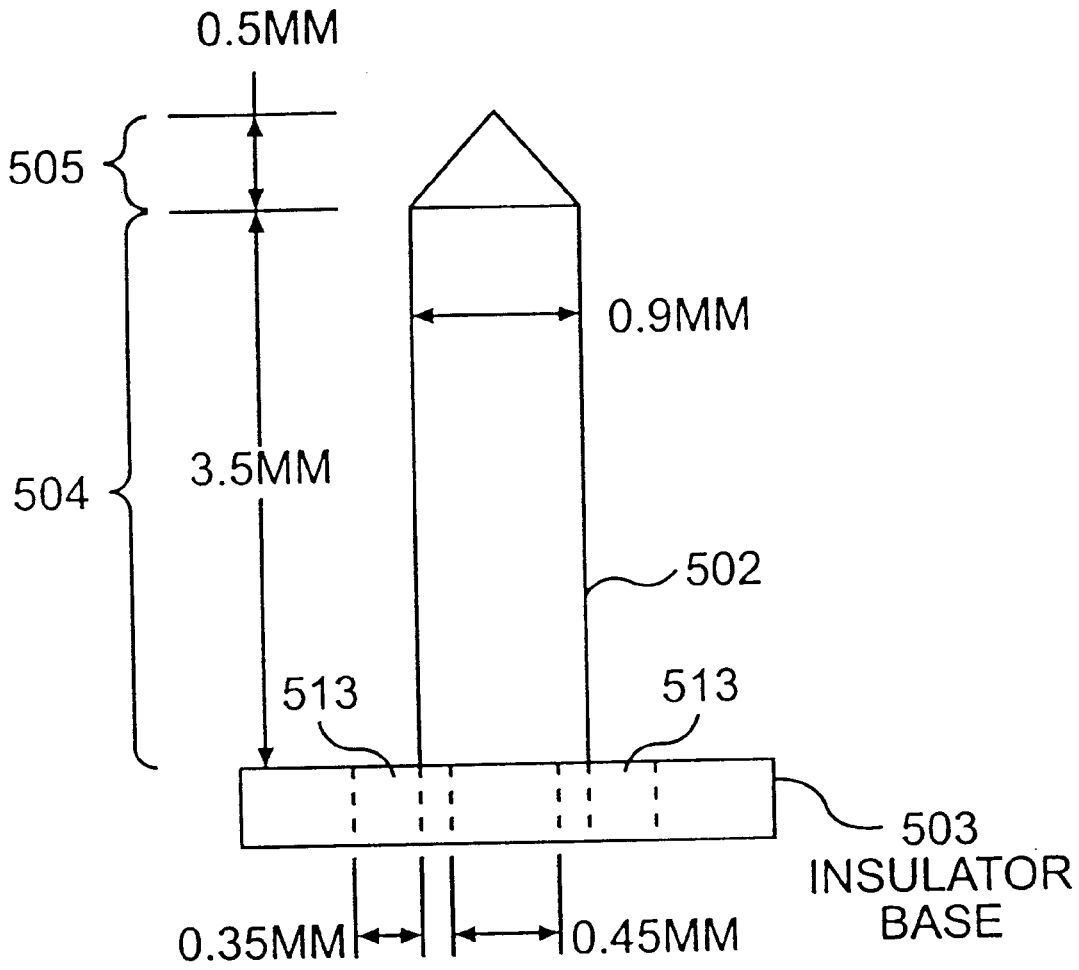
Figure 5C:
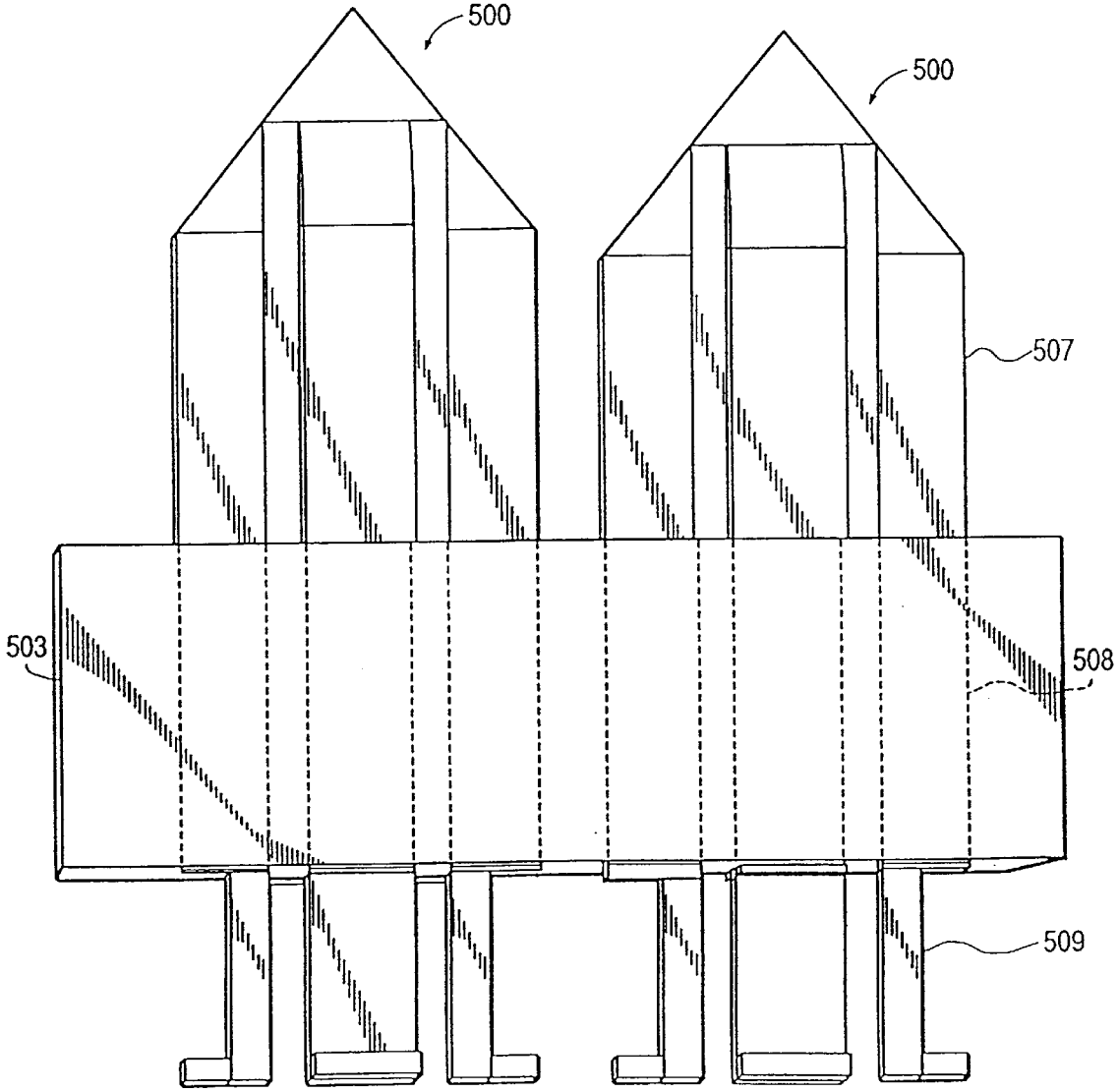

FIG. 5(*a*) is a perspective view of a portion of a projection-type interconnect component 500 in accordance with an embodiment of the present invention. The projection-type interconnect component includes several conductive posts 501. The projection-type interconnect component may also include an insulative buttress 502, although use of a buttress in the embodiment of FIG. 5(*a*) is not required. The conductive posts and the buttress (when used) are attached to an insulative substrate 503. The conductive posts are electrically isolated from one another by the substrate 503 and the buttress 502 (when used).

FIG. 5(*b*) is a side view of the buttress 502 and the insulative substrate 503. The buttress 502 and the substrate 503 may be integrally molded from a single unit of insulative material. Preferably, the material of the buttress and the substrate is an insulative material that does not shrink when molded (for example, a liquid crystal polymer such as Vectra, which is a trademark of Hoescht Celanese). The conductive posts 501 are inserted into the substrate 503 through holes in the substrate represented by the dotted lines in FIG. 5(*b*).

As seen from FIG. 5(*b*), the buttress 502 includes an elongated portion 504 having a rectangular (e.g., square) cross-section, and a tip portion 505 located at the top of the elongated portion. The buttress dimensions shown in FIG. 5(*b*) are exemplary and, accordingly, other dimensions for buttress 502 may be used. For example, the cross-section of the buttress 502 may be 0.5 mm by 0.5 mm rather than the illustrated dimensions of 0.9 mm by 0.9 mm.

Each conductive post 501 includes three sections: a contact portion, a stabilizing portion, and a foot portion. In FIG. 5(*a*), the contact portion of each conductive post is shown in a position adjacent the buttress 502. The stabilizing portion (not shown in FIG. 5(*b*)) is the portion of each post that is secured to the substrate 503. The foot portion (not shown in FIG. 5(*b*)) extends from the side of the substrate opposite the contact portion. The conductive posts may have a rectangular (e.g., square) cross-section, or a cross-section that is triangular, semicircular, or some other shape.

The three portions of each conductive post 501 can be seen more clearly in FIG. 5(*c*), which is a side view of two projection-type interconnect components 500 attached to the substrate 503. In FIG. 5(*c*), reference numeral 507 designates the contact portion of each conductive post 501; reference numeral 508 designates the stabilizing portion of each conductive post; and reference numeral 509 designates the foot portion of each conductive post. When the projection-type interconnect component 500 is received within a receiving-type interconnect component, electrical signals may be transferred from the foot portion of each conductive post 501 through the stabilizing and contact portions of that post to the receiving-type interconnect component, and vice versa.

Each conductive post 501 may be formed of beryllium copper, phosphor bronze, brass, a copper alloy, tin, gold, palladium, or any other suitable metal or conductive material. In a preferred embodiment, each conductive post 501 is formed of beryllium copper, phosphor bronze, brass, or a copper alloy, and plated with tin, gold, palladium, or a combination including at least two of tin, gold, and palladium. The entire surface of each post may be plated, or just a selected portion 506 corresponding to the portion of conductive post 501 that will contact a conductive beam when the projection-type interconnect component is received within the receiving-type interconnect component.

Figure 6:
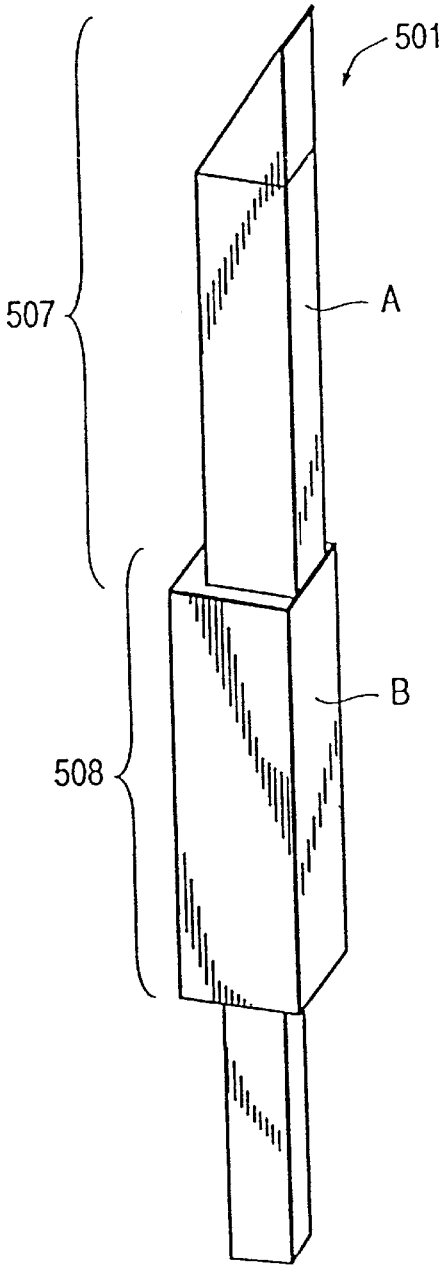
FIG. 6 is a perspective view of one type of conductive post that may be used in the electrical interconnect system of the present invention.

One type of conductive post 501 that may be used in the electrical interconnect system of the present invention is shown in FIG. 6. The post 501 of FIG. 6 is a non-offset or straight post, so-called because the respective surfaces A and B of the contact portion 507 and stabilizing portion 508 which face in the direction of the buttress are in alignment (i.e., surfaces A and B are coplanar).

Figure 7:
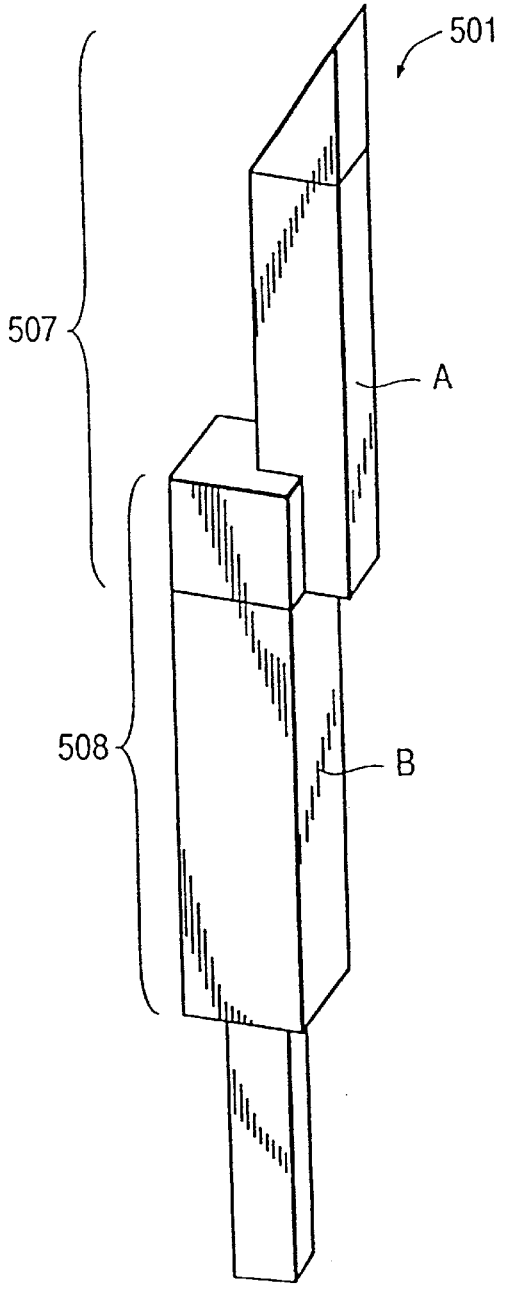
FIG. 7 is a perspective view of another type of conductive post that may be used in the electrical interconnect system of the present invention.

Another type of conductive post that may be used in the electrical interconnect system of the present invention is shown in FIG. 7. The conductive post 501 of FIG. 7 is called an offset post because the surface A of the contact portion 507 which faces in the direction of the buttress is offset in the direction of the buttress as compared to the surface B of the stabilizing portion 508 which faces in the direction of the buttress. In the post 501 of FIG. 7, surfaces A and B are not coplanar.

The offset post of FIG. 7 is used in situations where the buttress of projection-type interconnect component 500 is extremely small, or the projection-type interconnect component does not include a buttress, to achieve an ultra-high density. In situations other than these, the straight post of FIG. 6 may be used.

The different portions of each conductive post 501 each perform a different function. The contact portion 507 establishes contact with a conductive beam of the receiving-type interconnect component when the projection-type and receiving-type interconnect components are mated. The stabilizing portion 508 secures the conductive post to the substrate 503 during handling, mating, and manufacturing. The stabilizing portion 508 is of a dimension that locks the post into the substrate 503 while allowing an adequate portion of the insulative substrate to exist between adjacent conductive posts. The foot portion 509 connects to an interface device (e.g., a semiconductor chip, a printed wiring board, a wire, or a round, flat, or flex cable) using the electrical interconnect system as an interface. The contact and foot portions may be aligned or offset with respect to the stabilizing portion to provide advantages that will be discussed in detail below.

Figure 8:
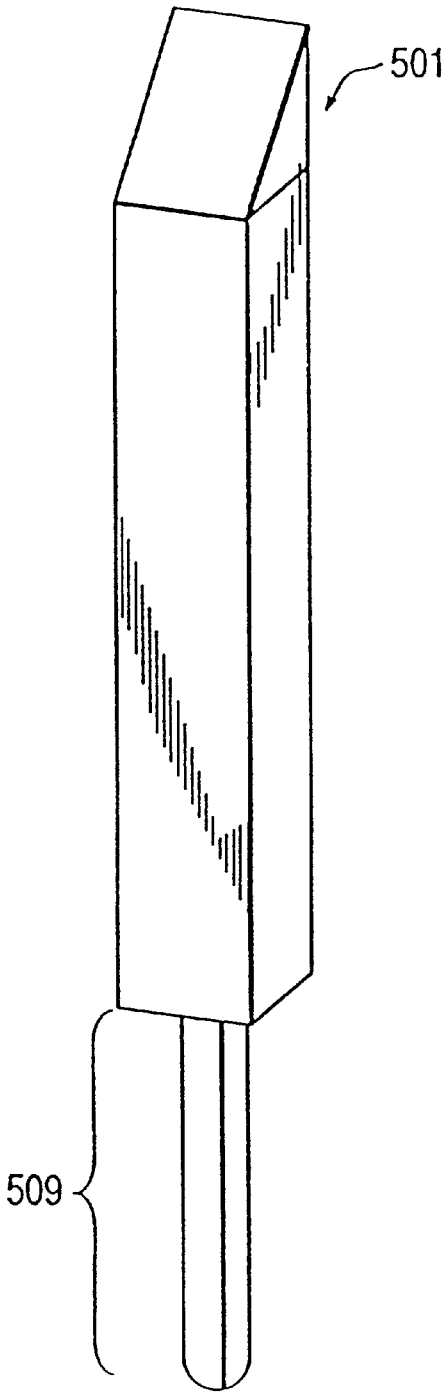
FIG. 8 is a perspective view of a conductive post in accordance with the present invention having a rounded foot portion.
Figure 9:
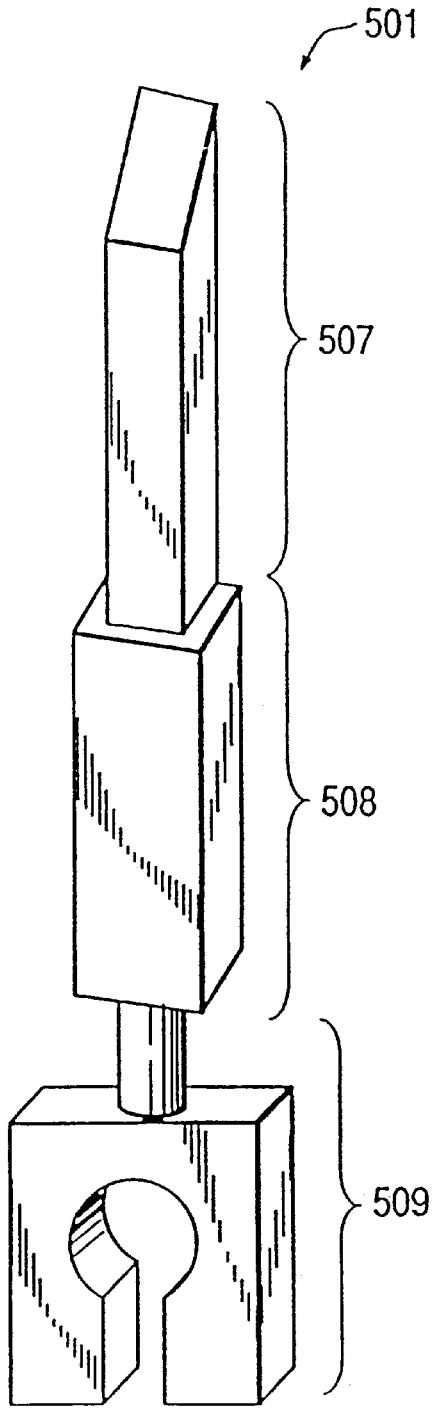
FIG. 9 is a perspective view of a conductive post in accordance with the present invention having a foot portion configured to interface with a round wire or cable.

The configuration of the foot portion 509 of each conductive post 501 depends on the type of device with which that foot portion is interfacing. For example, the foot portion 509 will have a rounded configuration (FIG. 8) if interfacing with a through-hole of a printed wiring board. The foot portion 509 will be configured as in FIG. 5(*c*) if interfacing with a printed wiring board through a surface mount process. If interfacing with a round cable or wire, the foot portion 509 will be configured as in FIG. 9. Other configurations may be used depending on the type of device with which the foot portion 509 is interfacing.

Figure 10:
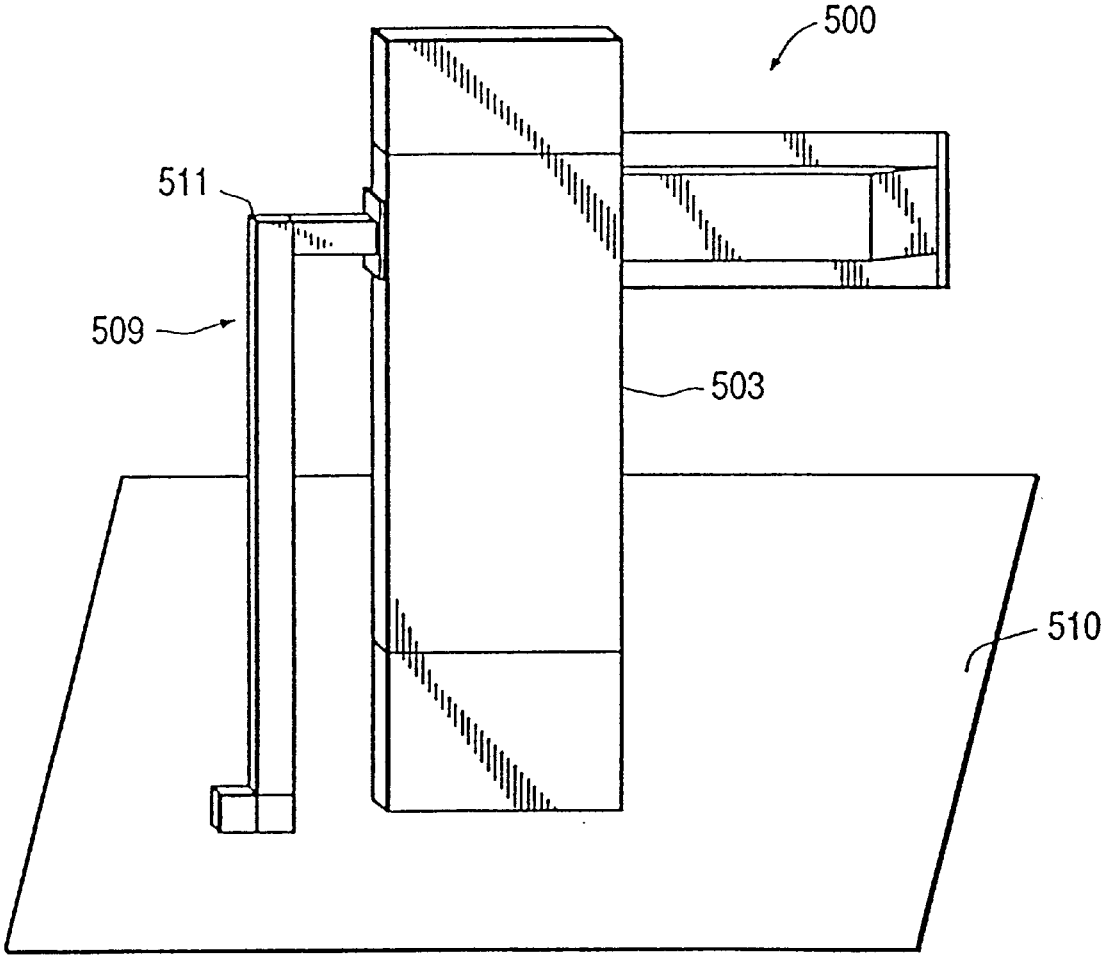
FIG. 10 is a perspective view showing a projection-type interconnect component located on a substrate arranged at a right angle with respect to an interface device.

FIG. 10 shows a foot portion 509 of a conductive post configured for surface mounting on a printed wiring board 510. As shown in FIG. 10, the substrate 503 may be positioned at a right angle with respect to the printed wiring board 510. This increases space efficiency and can facilitate cooling of the components on the wiring board and/or shorten various signal paths. Although not explicitly shown in FIG. 10, the substrate 503 may be positioned at a right angle with respect to the device with which the foot portion is interfacing (e.g., a flex cable or a round cable) regardless of the nature of the device. As seen from FIG. 10, such positioning necessitates the bending of the foot portion 509 at a right angle at a point 511 of the foot portion.

Figure 11A:
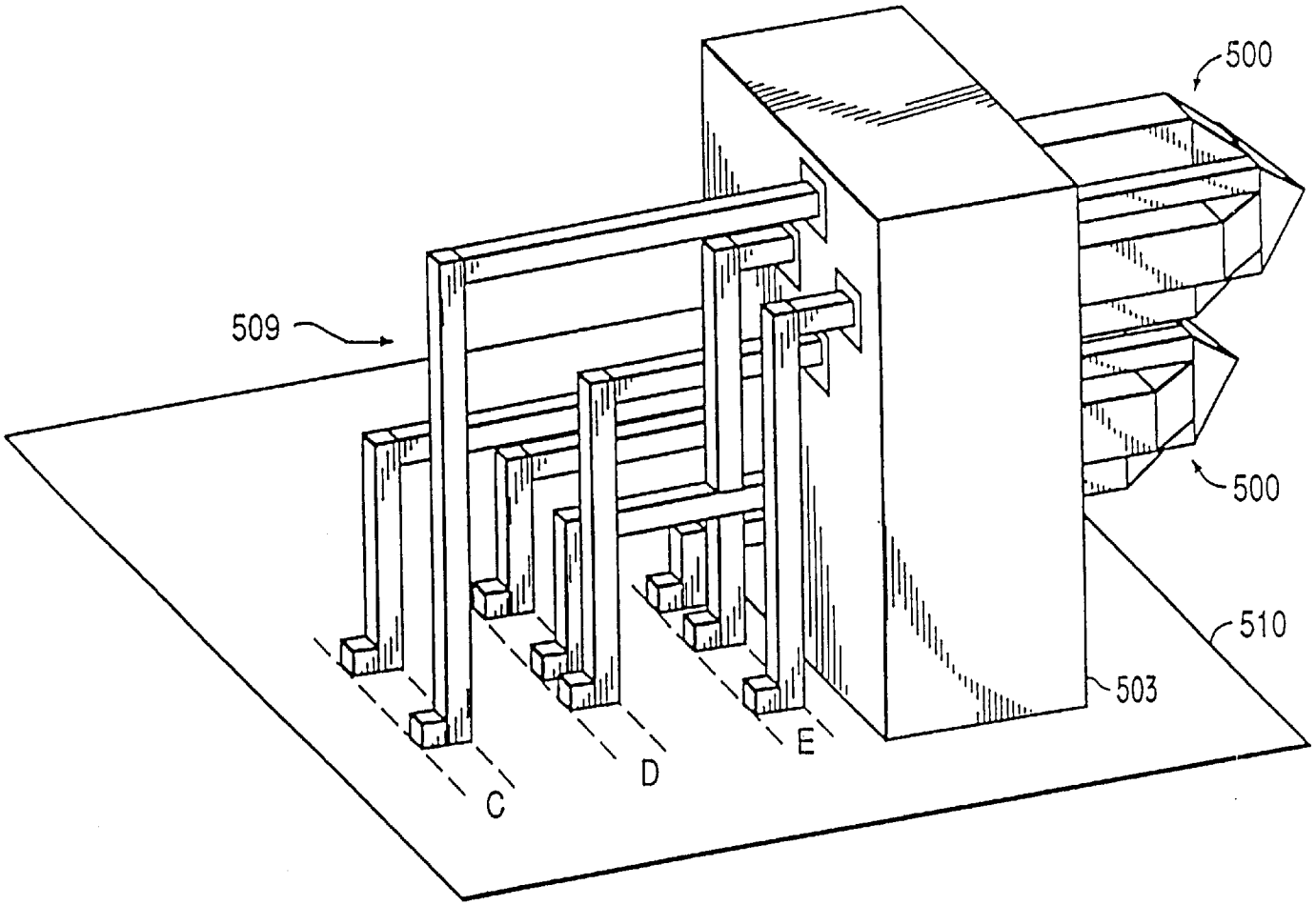
FIG. 11(*a*) is a perspective view showing several projection-type interconnect components located on a substrate arranged at a right angle with respect to an interface device.
Figure 11B:
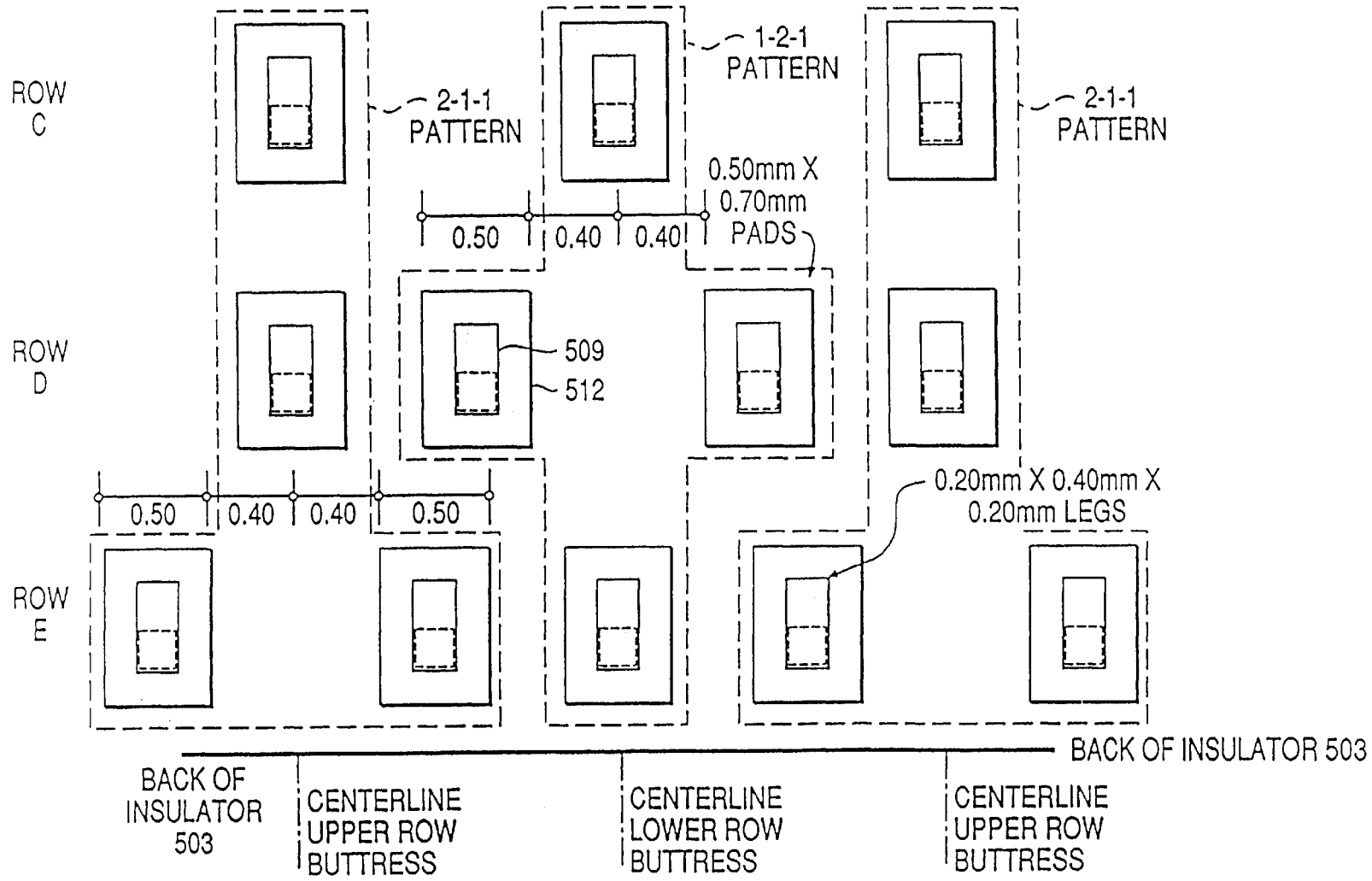

FIG. 11(*a*) illustrates a preferred arrangement of the various foot portions 509 when several projection-type electrical interconnect components 500 are attached to a substrate 503 positioned at a right angle with respect to the interface device (e.g., printed wiring board 510). With reference to FIG. 11(*a*), each foot portion 509 extends out from a vertical surface of substrate 503, and then bends toward the surface of the interface device at a point 511 of that foot portion. The foot portions 509 are bent such that the foot portions contact the interface device in three separate rows (i.e., rows C, D, and E of FIG. 11(*b*)).

FIG. 11(*b*) is a diagram showing that with three interconnect components 500 arranged in two rows, the foot portions 509 of such components can be arranged in three rows (C, D, and E) using patterns which alternate. As shown in FIG. 11(*b*), the foot portions 509 of alternating projection-type components 500 contact pads 512 of the interface device in "2-1-1" and "1-2-1" patterns. The alternating "2-1-1" and "1-2-1" patterns arrange the foot portions into three rows (C, D, and E), thereby decreasing signal path lengths, increasing speed, and saving space.

It should be noted that one or more rows (e.g., two additional rows) of interconnect components may be attached to substrate 503 rather than just the two rows illustrated in FIG. 11(*a*). If two additional rows of interconnect components are positioned above the two rows of components 500 illustrated in FIG. 11(*a*), for example, the foot portions of the additional components would extend over the foot portions of the lower two rows and then bend toward the interface device 510 just like the foot portions of the lower two rows. The alternating patterns formed by the additional foot portions would be identical to the alternating patterns illustrated in FIG. 11(*b*), but located further away from the substrate 503 than the patterns of the lower two rows.

Figure 12:
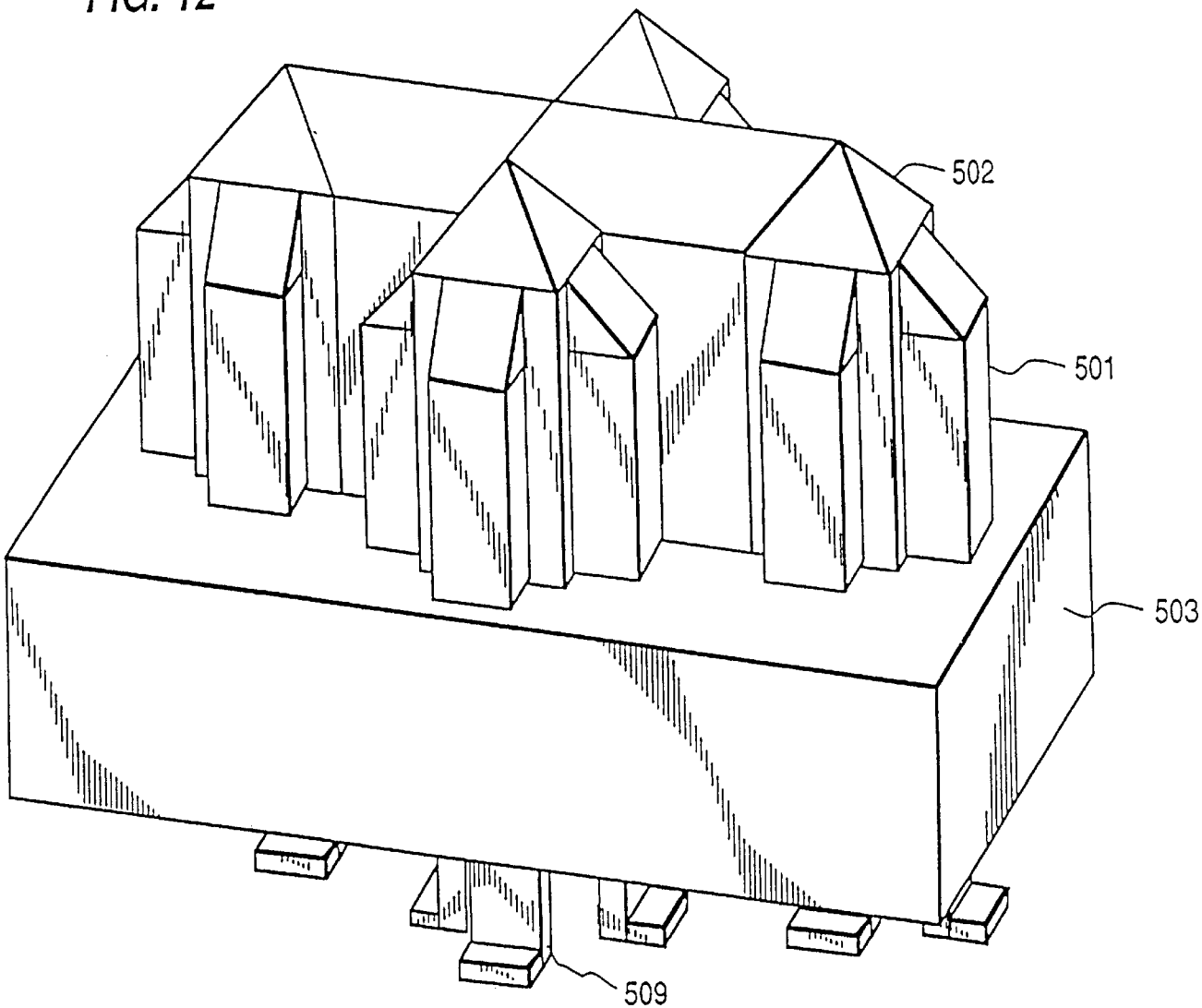
FIG. 12 is a perspective view of a projection-type electrical interconnect component in accordance with another embodiment of the present invention.

FIG. 12 shows that in an alternate embodiment, the projection-type component 500 may include a cross-shaped buttress 502 surrounded by a plurality of conductive posts 501. In FIG. 12, the foot portion 509 of each conductive post 501 is configured for surface mounting on a printed wire board with the substrate 503 positioned parallel to the surface of the board. Although twelve conductive posts are illustrated in FIG. 12, one for each vertical surface of the buttress 502, either more or less than twelve conductive posts may be positioned around the buttress. Except for the arrangement and number of the conductive posts and the shape of the buttress, the projection-type electrical interconnect component of FIG. 12 is identical to the one shown in FIG. 5(*a*). Thus, as with the embodiment of FIG. 5(*a*), the projection-type interconnect component of FIG. 12 may be used without buttress 502.

Figure 13A:
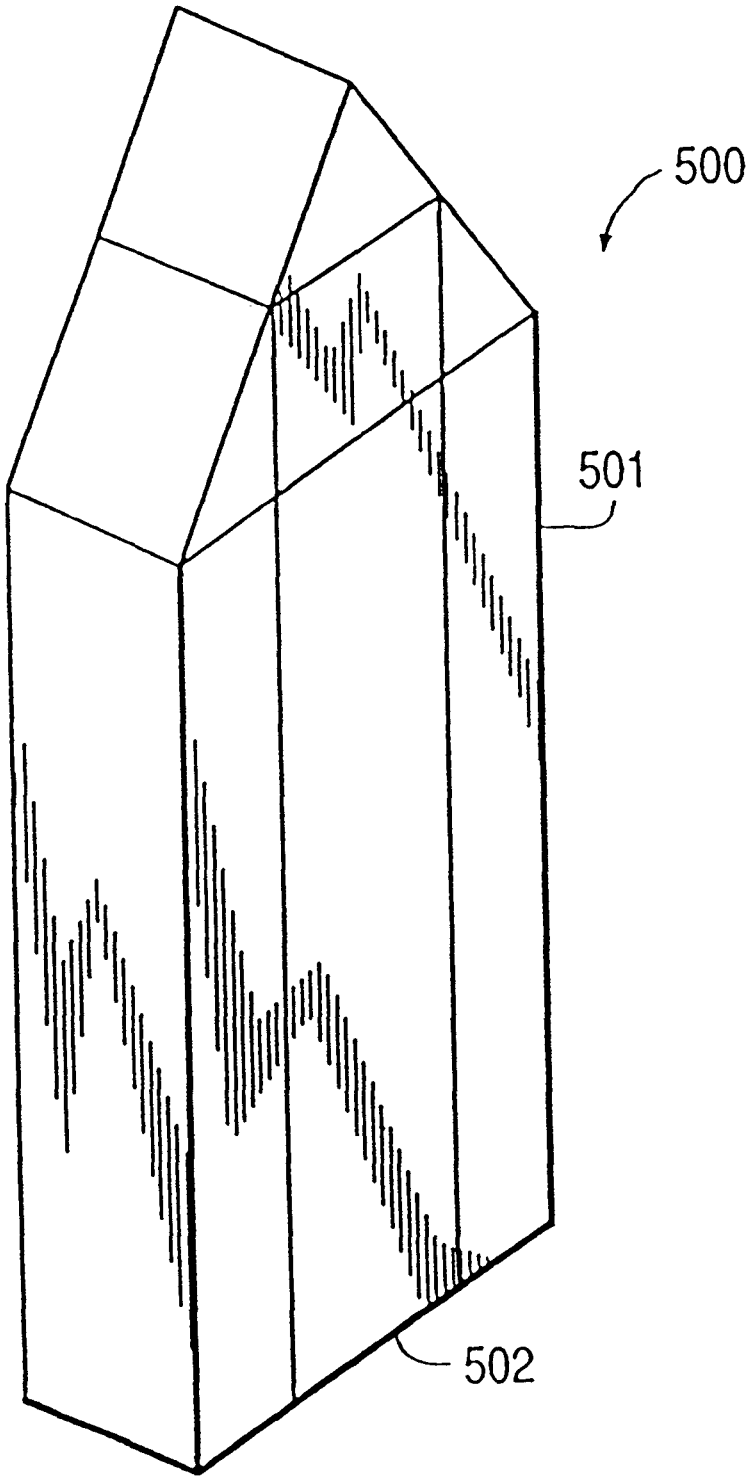
FIG. 13(*a*) is a perspective view of a projection-type electrical interconnect component in accordance with yet another embodiment of the present invention.
Figure 13C:
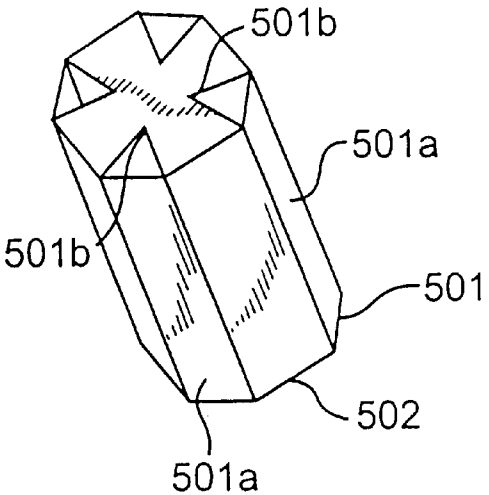
Figure 13B:
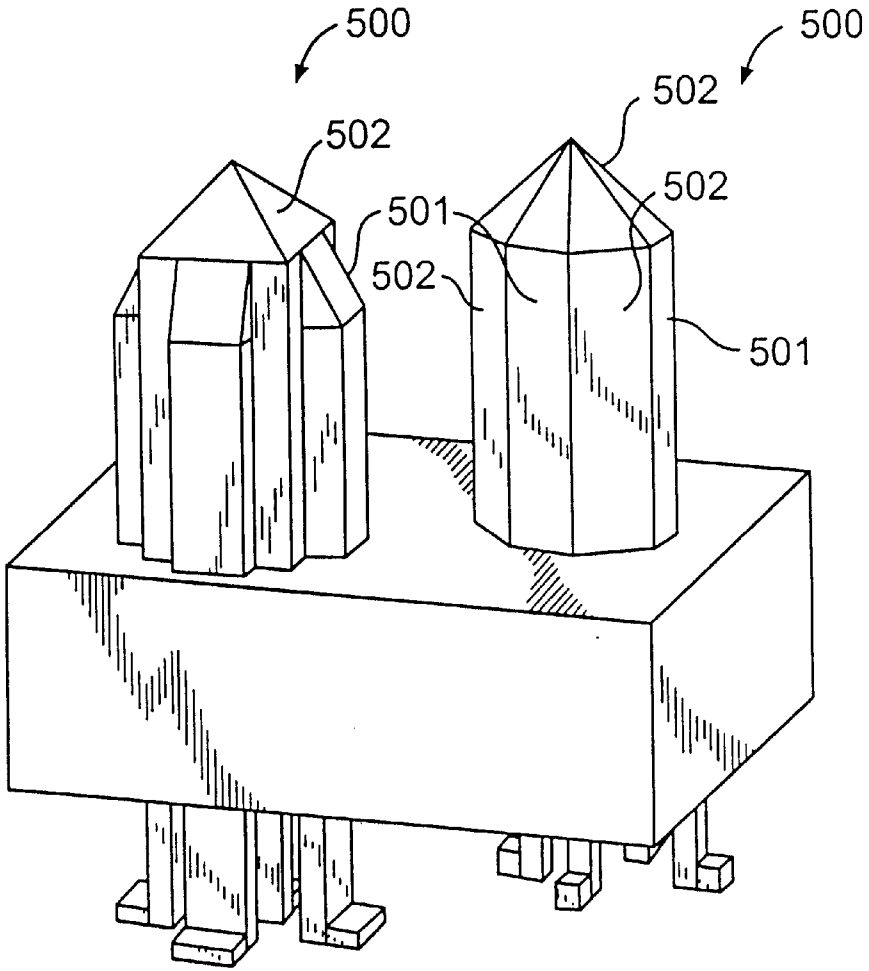

FIG. 13(*a*) shows yet another alternate embodiment of the projection-type component 500 wherein the tip portion of the buttress 502 has two sloped surfaces instead of four sloped surfaces, and each conductive post has the same width as a side of the buttress 502. Except for the shape of the tip portion and the number and width of the conductive posts 501 surrounding the buttress 502, the projection-type interconnect component is identical to the one shown in FIG. 5(*a*). Consequently, although two conductive posts are illustrated in FIG. 13(*a*), either more or less than two conductive posts may be positioned around the buttress 502. Further, as with the embodiment of FIG. 5(*a*), the projection-type interconnect component of FIG. 13(*a*) may be used without buttress 502. Also, the width of each conductive post 502 may be greater or lesser than the width of a side of the buttress.

FIG. 13(*b*) shows a projection-type interconnect component 500 in accordance with the embodiment of the present invention illustrated in FIG. 5(*a*). FIG. 13(*b*) also shows a projection-type interconnect component 500 in accordance with still another embodiment of the present invention. The former interconnect component is the leftward component shown in FIG. 13(*b*), and the latter interconnect component is the rightward component shown in FIG. 13(*b*).

FIG. 13(*c*) shows a portion of the rightward interconnect component with the tip portion of the component removed. The interconnect component of FIG. 13(*c*) has several conductive posts 501 each including a contact portion having a triangular cross-section. The interconnect component of FIG. 13(*c*) may also include a buttress 502 having a substantially cross-shaped or X-shaped cross-section, although the buttress may be eliminated if desired. The embodiment of FIG. 13(*c*) allows close spacing between the posts 501 and may use a buttress 502 having a reduced thickness as compared to buttresses which may be used in connection with other embodiments of the present invention.

The projection-type interconnect components shown in the drawings are exemplary of the types of interconnect components that may be used in the electrical interconnect system of the present invention. Other projection-type interconnect components are contemplated.

C. The Receiving-Type Interconnect Component

The receiving-type electrical interconnect component of the present invention includes several electrically conductive beams attached to an insulative substrate. The receiving-type electrical interconnect component is configured to receive a projection-type electrical interconnect component within a space between the conductive beams. The substrate insulates the conductive beams from one another so that a different electrical signal may be transmitted on each beam.

Figure 14:
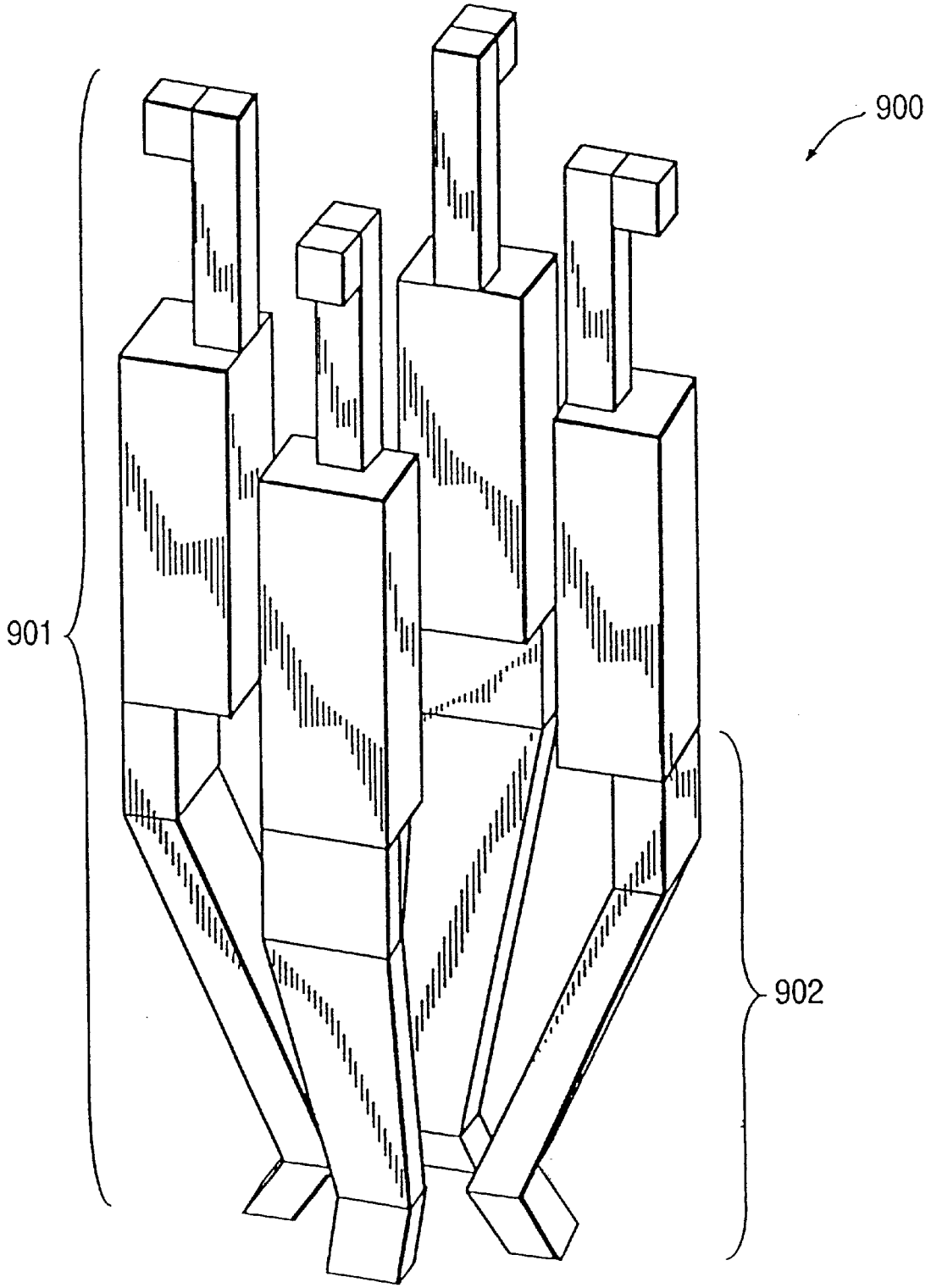
FIG. 14 is a perspective view of a portion of a receiving-type interconnect component in accordance with an embodiment of the present invention.

FIG. 14 illustrates a portion of a receiving-type interconnect component 900 in accordance with an embodiment of the present invention. The receiving-type component 900 comprises several electrically conductive, flexible beams 901 attached to an electrically insulated substrate (not shown in FIG. 14). Preferably, the material of the substrate is an insulative material that does not shrink when molded (for example, a liquid crystal polymer such as Vectra, which is a trademark of Hoescht Celanese). Portions of the conductive beams 901 bend away from each other to receive the projection-type interconnect component within the space between the conductive beams.

Each conductive beam 901 may be formed from the same materials used to make the conductive posts 501 of the projection-type electrical interconnect component. For example, each conductive beam 901 may be formed of beryllium copper, phosphor bronze, brass, or a copper alloy, and plated with tin, gold, or palladium at a selected portion of the conductive beam which will contact a conductive post of the projection-type interconnect component when the projection-type interconnect component is received with the receiving-type interconnect component 900.

Figure 15:
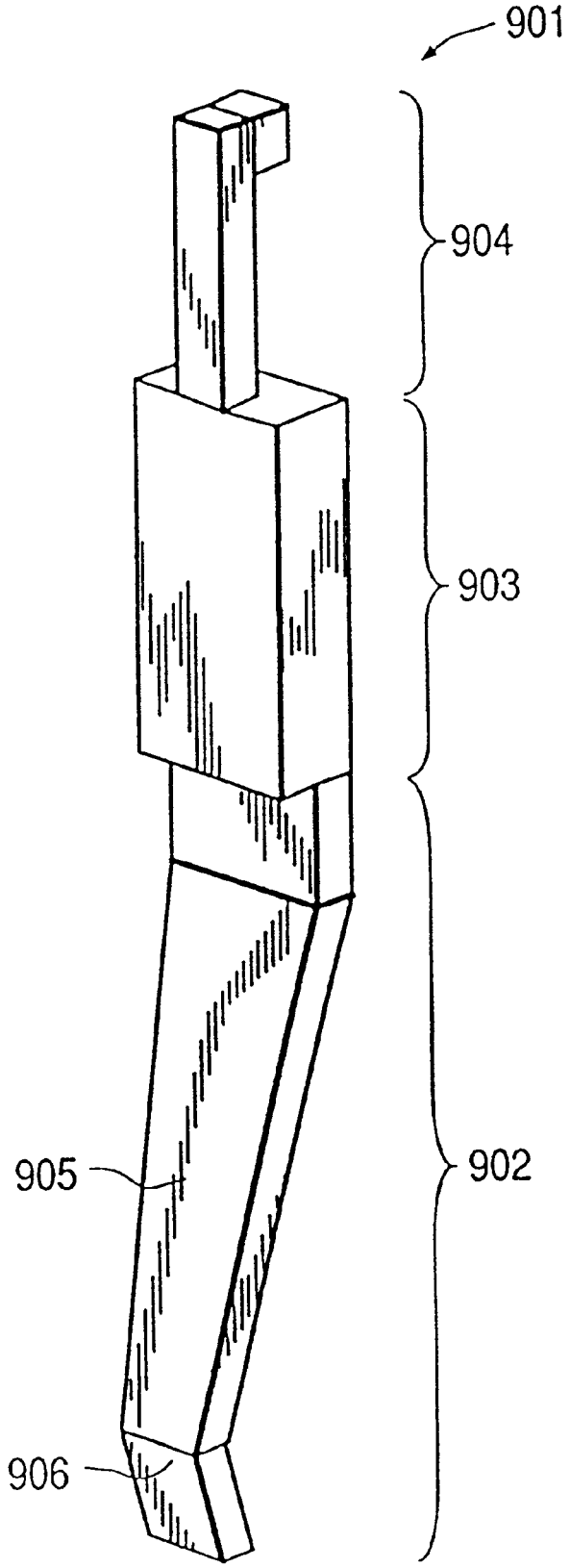
FIG. 15 is a perspective view showing an example of a conductive beam that may be used in the electrical interconnect system of the present invention.

An example of a conductive beam 901 that may be used in the electrical interconnect system of the present invention is shown in FIG. 15. With reference to FIG. 15, each conductive beam 901 of the present invention includes three sections: a contact portion 902; a stabilizing portion 903; and a foot portion 904.

The contact portion 902 of each conductive beam 901 contacts a conductive post of the projection-type receiving component when the projection-type receiving component is received within the receiving-type interconnect component. The contact portion 902 of each conductive beam includes an interface portion 905 and a lead-in portion 906. The interface portion 905 is the portion of the conductive portion 902 which contacts a conductive post when the projection-type and receiving-type interconnect components are mated. The lead-in portion 906 comprises a sloped surface which initiates separation of the conductive beams during mating upon coming into contact with the tip portion of the buttress of the projection-type interconnect component (or, when a buttress is not used, upon coming into contact with one or more posts of the projection-type interconnect component).

Figure 16A:
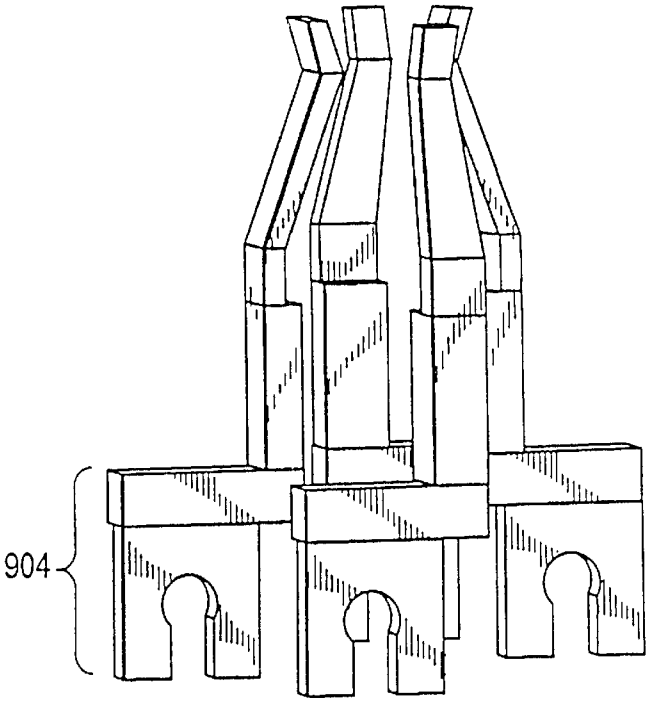
FIG. 16(*a*) is a perspective view of a plurality of flexible beams of a receiving-type interconnect component each having a wire or cable interface foot portion.
Figure 16B:
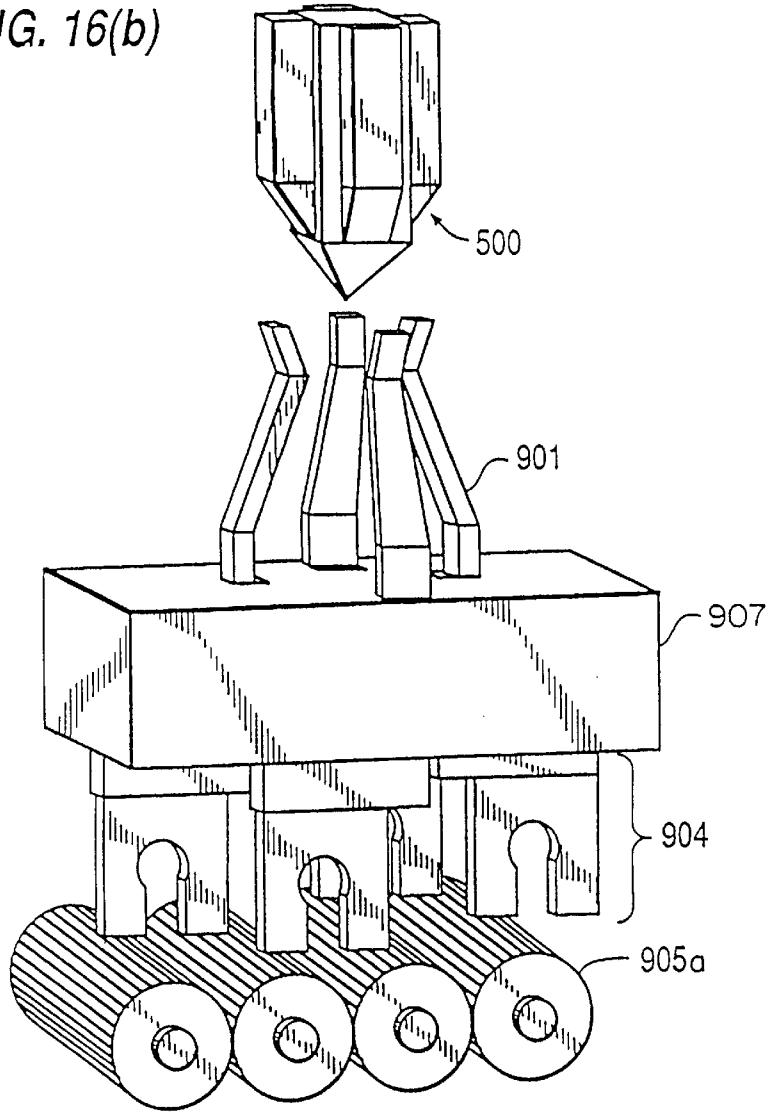

The stabilizing portion 903 is secured to the substrate (e.g., substrate 907 of FIG. 16(*b*)) that supports the conductive beam 901. The stabilizing portion 903 of each conductive beam prevents that beam from twisting or being dislodged during handling, mating, and manufacturing. The stabilizing portion 903 is of a dimension that locks the beam into the substrate while allowing an adequate portion of the insulative substrate to exist between adjacent conductive beams.

The foot portion 904 is very similar to the foot portion 509 of the conductive post 501 described above in connection with the projection-type interconnect component 500. Like foot portion 509, the foot portion 904 connects to an interface device (e.g., a semiconductor chip, a printed wiring board, a wire, or a round, flat, or flex cable) which uses the electrical interconnect system as an interface.

In the same manner as foot portion 509, the configuration of the foot portion 904 depends on the type of device with which it is interfacing. Possible configurations of the foot portion 904 are the same as the possible configurations discussed above in connection with the foot portion 509 above. For example, FIGS. 16(*a*) and 16(*b*) show the configuration of the foot portion 904 used when interfacing with a round cable or wire 905*a*. In particular, FIG. 16(*b*) shows the receiving-type component 900 prior to mating with the projection-type component 500, with the conductive beams 901 attached to an insulative substrate 907, and the foot portion 904 of each beam positioned for interfacing with round wire or cable 905*a*.

Like foot portion 509, the foot portion 904 will be bent at a right angle in situations where the substrate of the receiving-type interconnect component is located at a right angle with respect to the interface device with which the foot portion 904 is interfacing. The contact and foot portions of each conductive beam may be aligned or offset with respect to the stabilizing portion to provide advantages that will be discussed in detail below.

Figure 17:
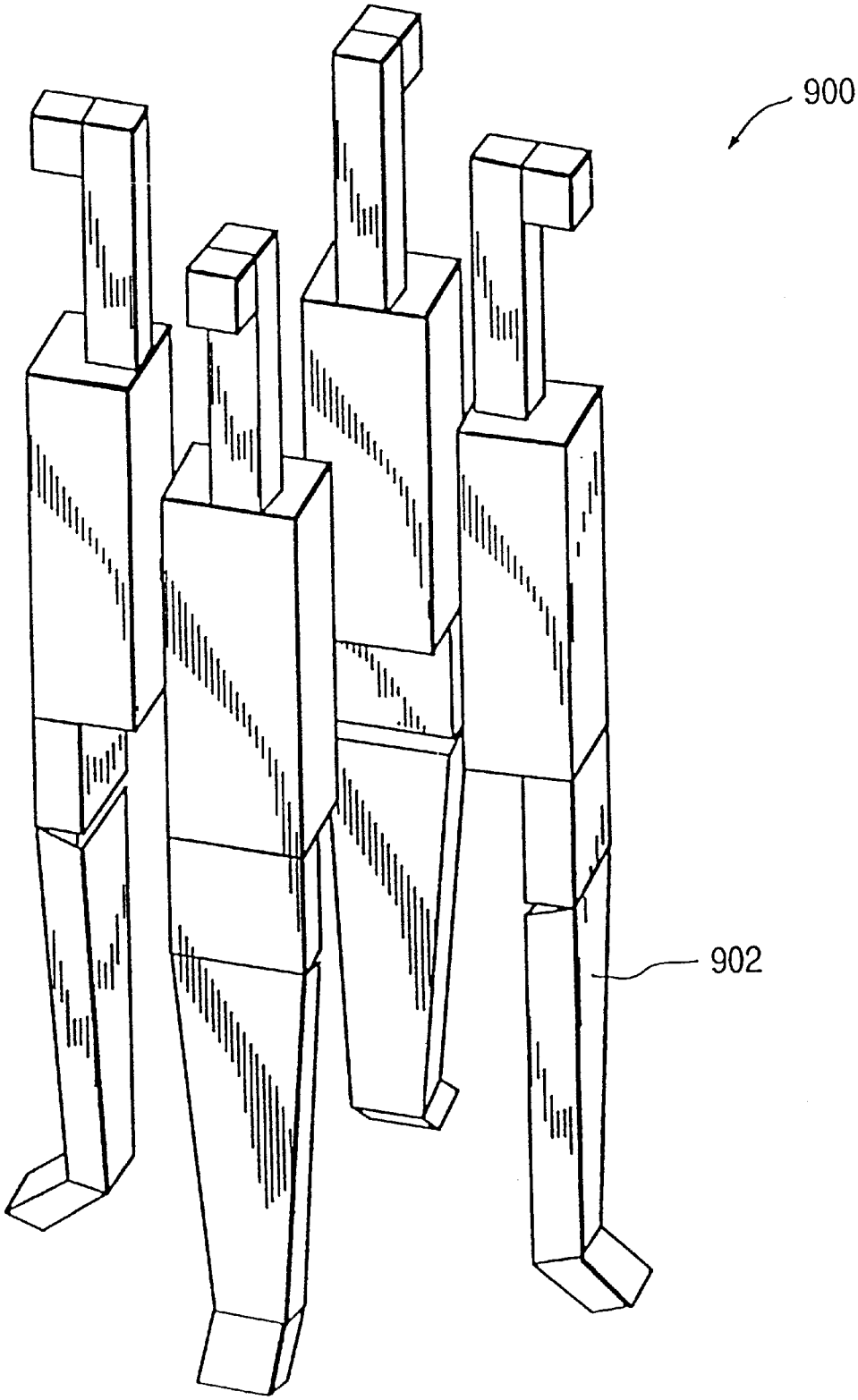
FIG. 17 is a perspective view showing the receiving-type interconnect component of FIG. 14 in a mated condition.

FIG. 17 shows the receiving-type interconnect component 900 in the mated condition. When the projection-type and receiving-type interconnect components are mated, the contact portions 902 of the conductive beams bend or spread apart to receive the projection-type interconnect component within the space between the contact portions of the conductive beams.

Figure 18:
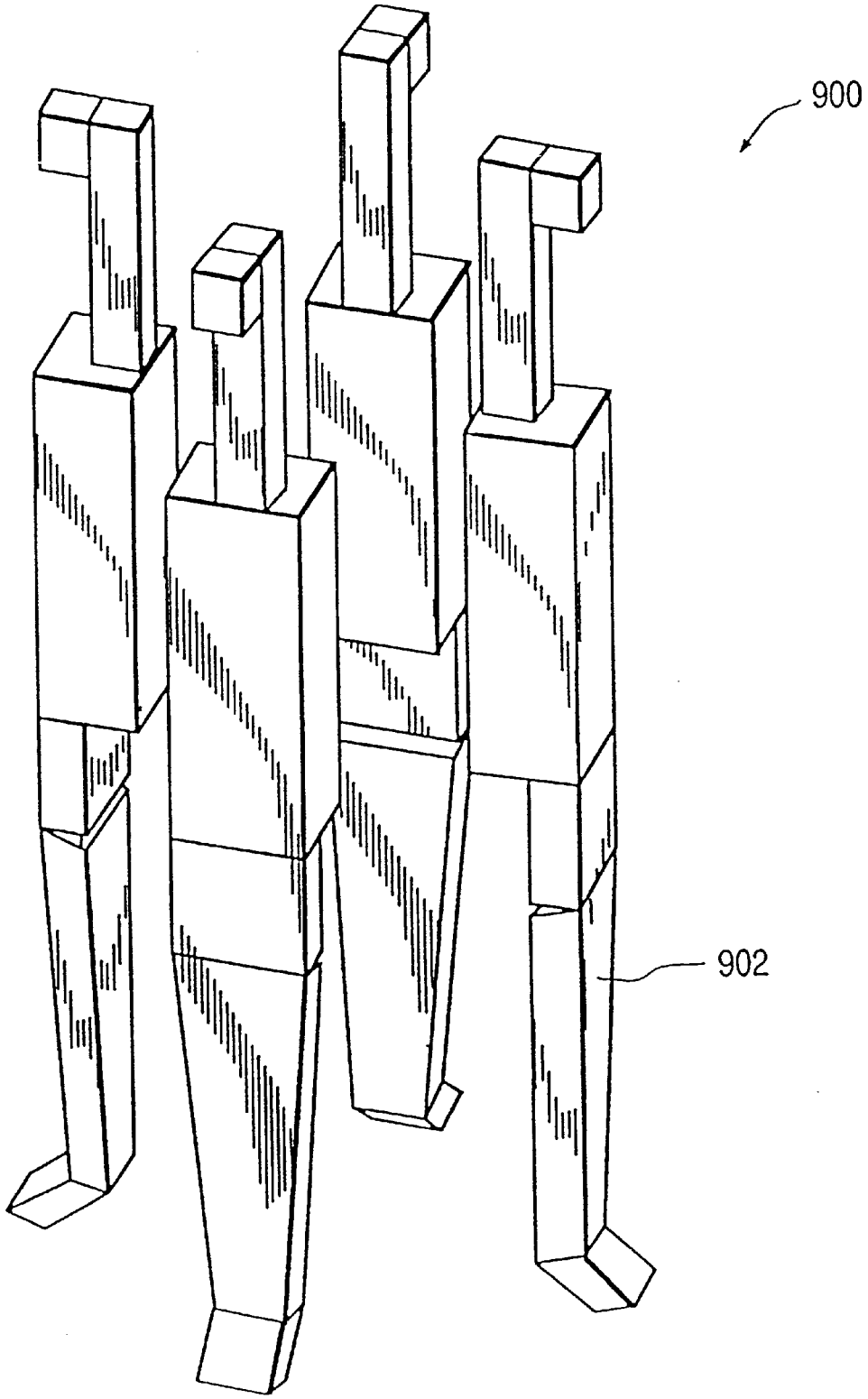
FIG. 18 is a perspective view of a portion of a receiving-type interconnect component in accordance with another embodiment of the present invention.

FIG. 18 illustrates an alternate embodiment of the receiving-type interconnect component 900. Like the embodiment of FIG. 17, the receiving-type interconnect component 900 includes several electrically conductive, flexible beams. In the embodiment of FIG. 18, however, the contact portion 902 for two of the beams is longer than the contact portion for the other two beams.

It should be noted that the configuration of the receiving-type component depends on the configuration of the projection-type interconnect component, or vice versa. For example, if the projection-type interconnect component comprises a cross-shaped buttress surrounded by conductive posts, then the receiving-type component should be configured to receive that type of projection-type interconnect component.

D. Mating of the Interconnect Components

Figure 19:
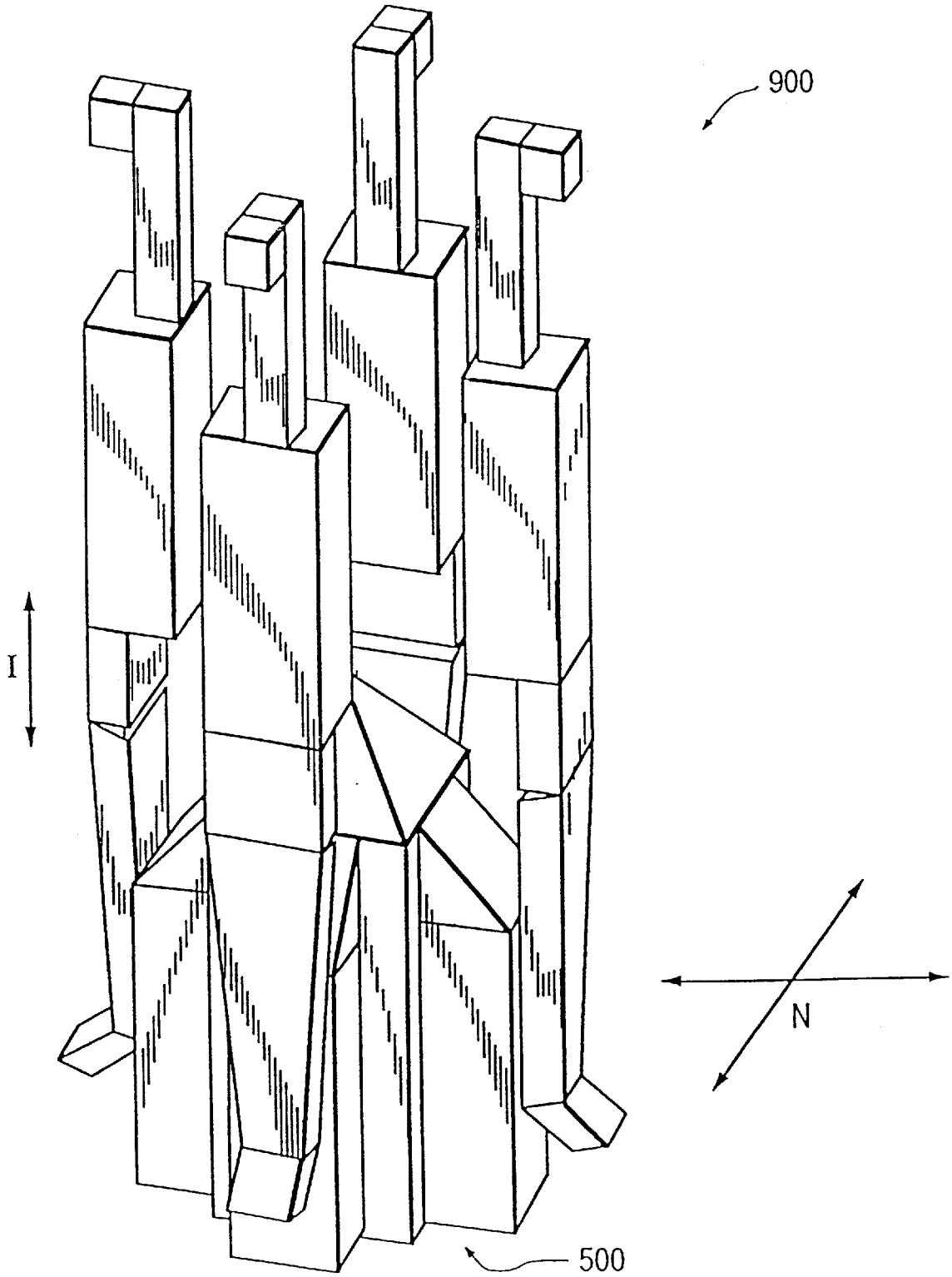
FIG. 19 is a perspective view showing a projection-type interconnect component received within a receiving-type interconnect component.

FIG. 19 shows a projection-type interconnect component 500 received within the conductive beams of a receiving-type interconnect component 900. When the projection-type interconnect component is received within the receiving-type interconnect component in this fashion, such interconnect components are said to be mated.

The mated position shown in FIG. 19 is achieved by moving the projection-type interconnect component 500 and the receiving-type interconnect component 900 toward one another in the direction of arrow I shown in FIG. 19. In the mated position, the contact portion of each conductive beam exerts a normal force against a contact portion of a corresponding one of the conductive posts in a direction within plane N. In FIG. 19, arrow I is perpendicular with respect to plane N.

The process of mating projection-type interconnect component 500 with receiving-type interconnect component 900 will now be discussed with reference to FIGS. 5(*a*), 14, 15, 19, and 20. FIGS. 5(*a*) and 14 show the state of the projection-type interconnect component 500 and the receiving-type interconnect component 900 prior to mating. As can be seen from FIG. 14, the contact portions 902 of the beams of the receiving-type interconnect component are clustered together before mating with the projection-type interconnect component.

Figure 20:
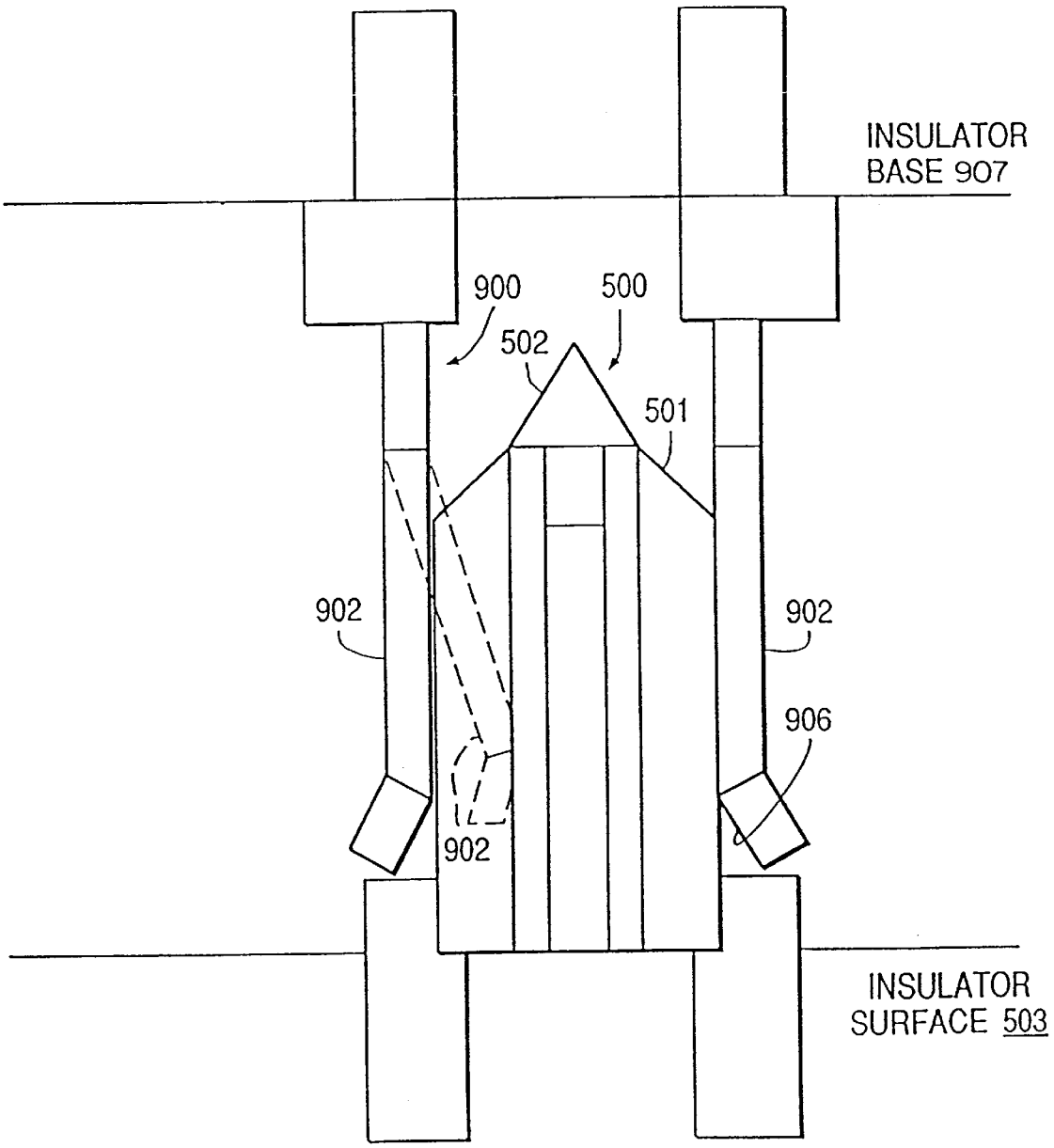
FIG. 20 is a side view of a projection-type interconnect component received within a receiving-type interconnect component.

Next, the projection-type and receiving-type interconnect components are moved toward one another in the direction of the arrow I shown in FIG. 19. Eventually, the lead-in portion 906 (FIG. 15) of each conductive beam 901 contact the tip portion of the buttress 502 (when used). Upon further relative movement of the interconnect components toward one another, the sloped configuration of the tip portion causes the contact portions 902 of the conductive beams to start to spread apart. Further spreading of the contact portions 902 occurs with additional relative movement between the interconnect components due to the sloped upper surfaces of the conductive posts 501 of the receiving-type component. Such spreading causes the conductive beams 901 to exert a normal force against the conductive posts 501 in the fully mated position (FIGS. 19 and 20), thereby ensuring reliable electrical contact between the beams and posts. In FIG. 20, solid lines are used to show the condition of the conductive beams in the mated position, while the dotted line shows one of the conductive beams in its condition prior to mating. It should be noted that when a buttress is not used, the initial spreading of the contact portions 902 is caused by one or more posts 501 of the projection-type interconnect component rather than a buttress tip portion.

The insertion force required to mate the projection-type interconnect 500 within the receiving-type interconnect component 900 is highest at the point corresponding to the initial spreading of the conductive beams 901. The insertion force required to mate the projection-type and receiving-type interconnect components can be reduced (and programmed mating, wherein one or more interconnections are completed before one or more other interconnections, may be provided) using a projection-type interconnect component having conductive posts which vary in height. An example of such a projection-type interconnect component is shown in FIG. 21.

Figure 21:
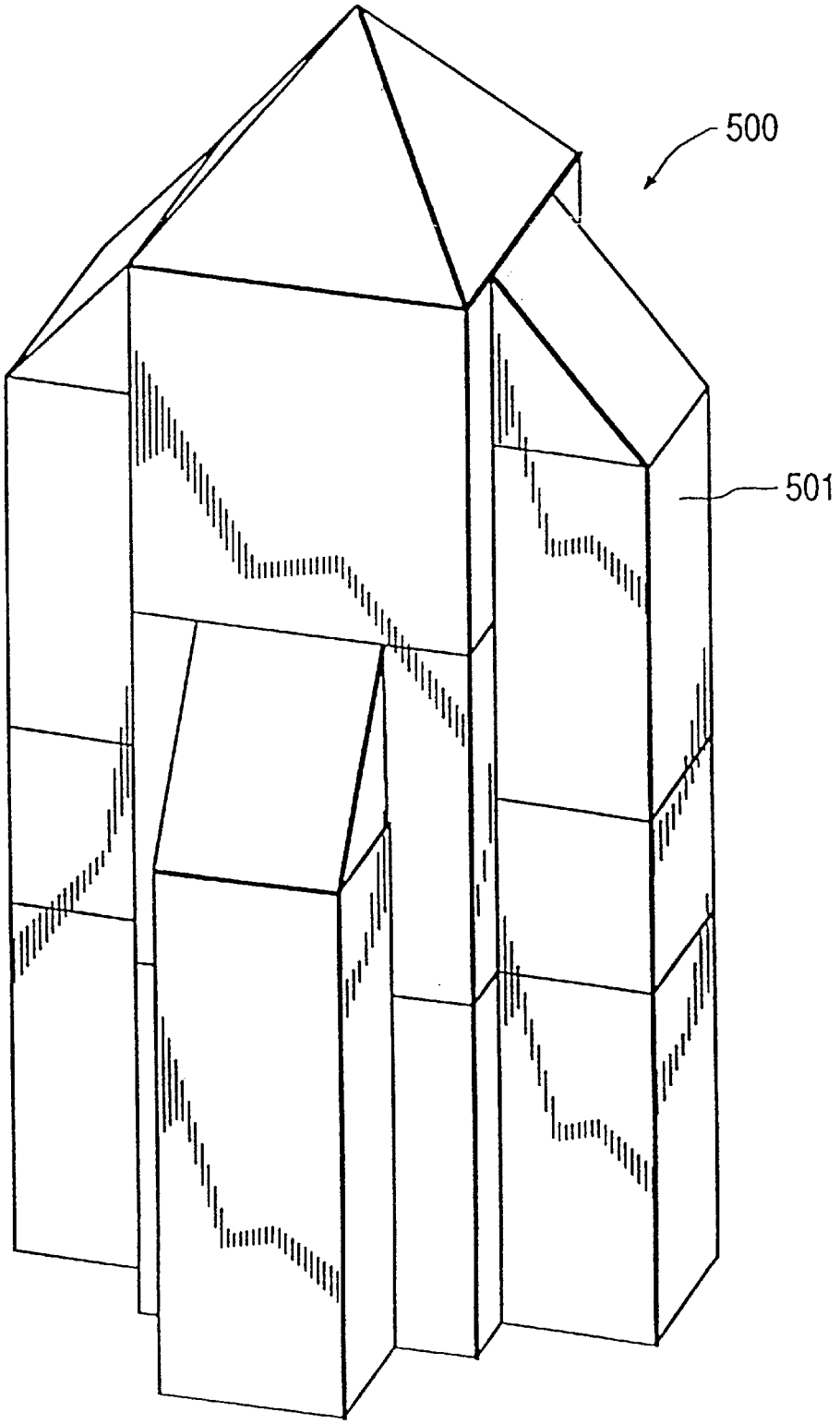
FIG. 21 is a perspective view of a portion of a projection-type interconnect component having conductive posts which vary in height.

As seen in FIG. 21, conductive posts 501 can be arranged so that one pair of opposing posts has a first height, and the other pair of opposing posts has a second height. In essence, the configuration of FIG. 21 breaks the peak of the initial insertion force into separate components occurring at different times so that the required insertion force is spread out incrementally over time as the mating process is carried out.

Figure 22:
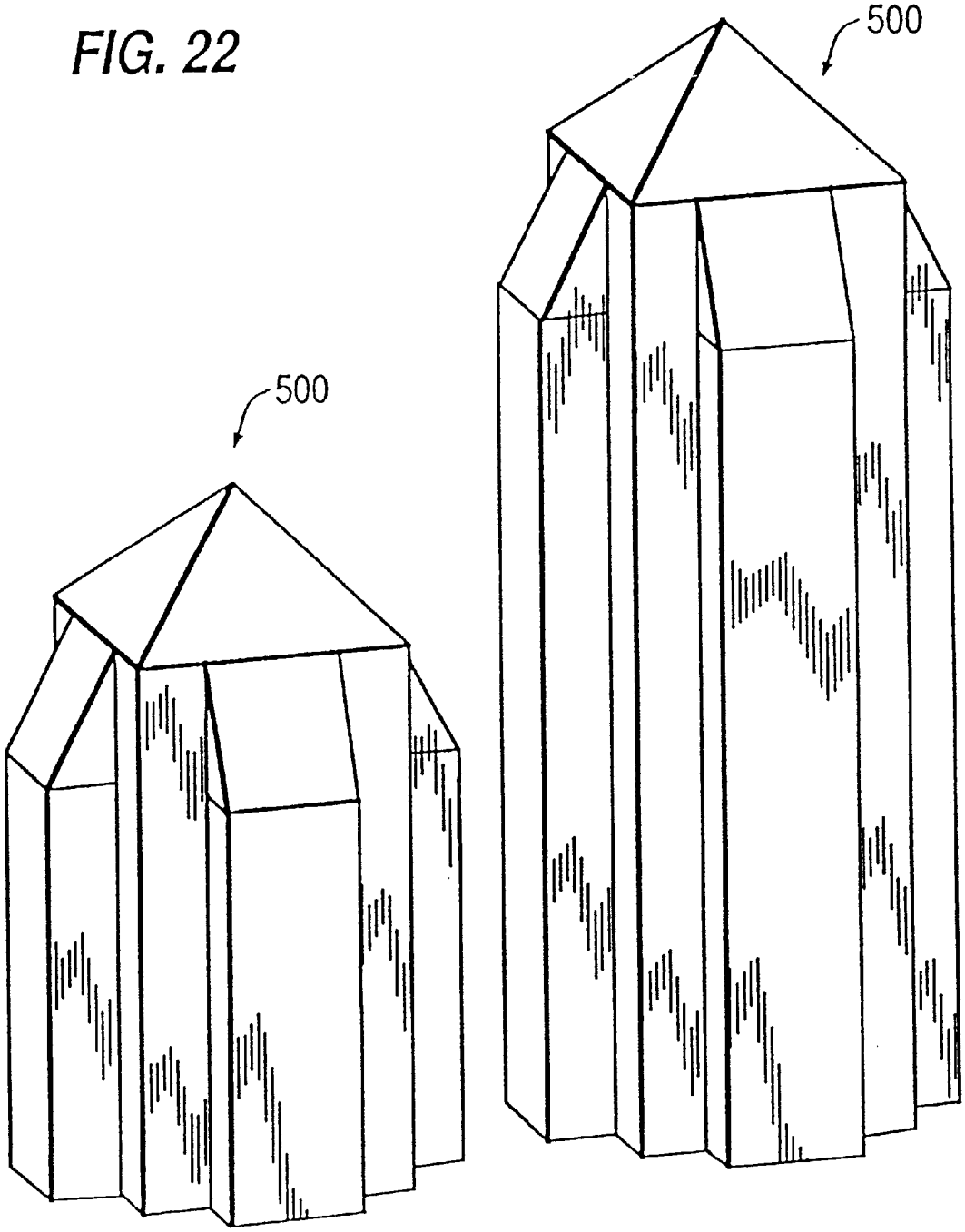
FIG. 22 is a perspective view of several projection-type interconnect components having different heights.

FIG. 22 illustrates another way in which the required insertion force can be spread out over time as mating occurs (and in which programmed mating can be provided). With reference to FIG. 22, different rows of projection-type interconnect components 500 can have different heights so that mating is initiated for different rows of the interconnect components at different times. The rows may can be alternately high and low in height, for example, or the height of the rows can increase progressively with each row. Also, the components within a given row may have different heights. Further, the embodiments of FIGS. 21 and 22 may be combined to achieve an embodiment wherein different rows of interconnect components vary in height, and the conductive posts of each interconnect component within the different rows also vary in height. Also, the conductive beams 901 or the contact portions 902 of each receiving-type interconnect component could vary in length as in FIG. 17 to similarly reduce the insertion force or provide programmed mating.

Figure 23B:
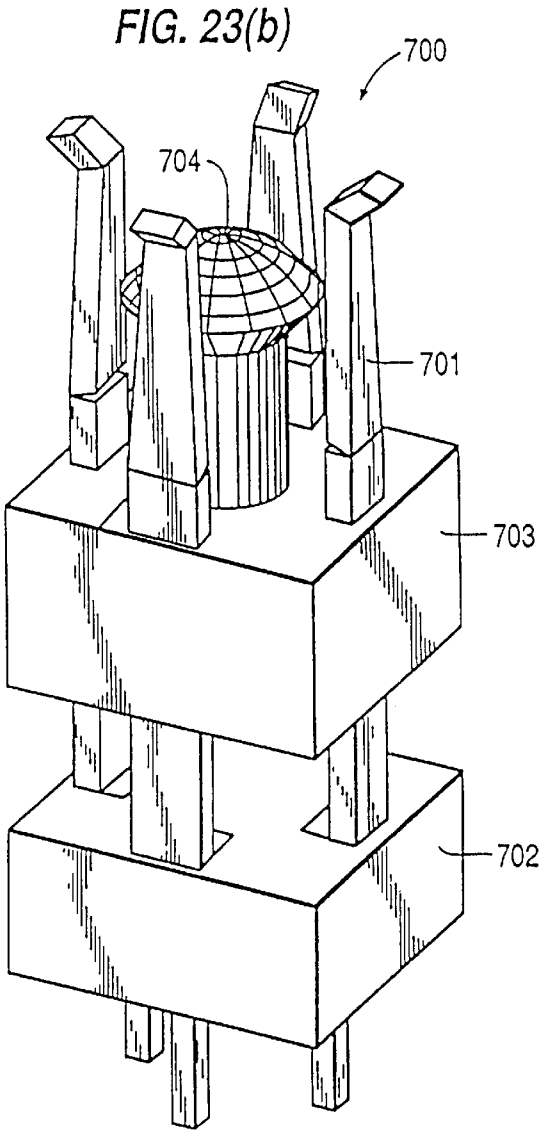
FIG. 23(*a*) is a perspective view of a first type of zero-insertion force component in a first state.
Figure 23A:
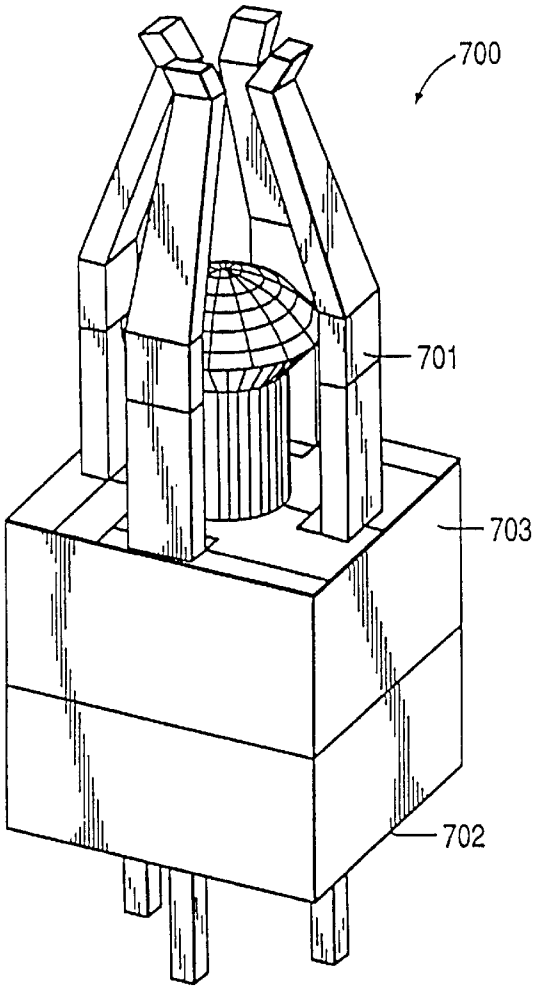

The insertion force can essentially be entirely eliminated using a zero-insertion force receiving-type interconnect component. FIGS. 23(*a*) and 23(*b*) (collectively referred to herein as FIG. 23) show a first type of zero-insertion force component 700, while FIGS. 24(*a*) and 24(*b*) (collectively referred to herein as FIG. 24) show a second type of zero-insertion force component 800.

With reference to FIG. 23, zero-insertion force interconnect component 700 includes a plurality (e.g., four) of conductive beams 701 supported by an insulative substrate 702. The interconnect component 700 also includes a movable substrate 703 and a bulbous member 704 fixed to the movable substrate. The movable substrate may be manually operated, or operated by machine. Also, the bulbous member may be replaced by a straight member with no bulb.

FIG. 23(*a*) shows the initial state of the interconnect component 700. Prior to mating the interconnect component 700 with a projection-type interconnect component, the movable substrate 703 is moved upward as depicted in FIG. 23(*b*) causing bulbous member 704 to spread apart the conducive beams 701. By spreading the conductive beams 701 prior to mating, the insertion force normally associated with the insertion of the projection-type interconnect component is essentially eliminated. The bulbous member 704 moves back into its original position in response to insertion of the projection-type interconnect component or under the control of a separate mechanical device such as a cam, thereby releasing the beams of the receiving-type interconnect component.

Figure 24B:
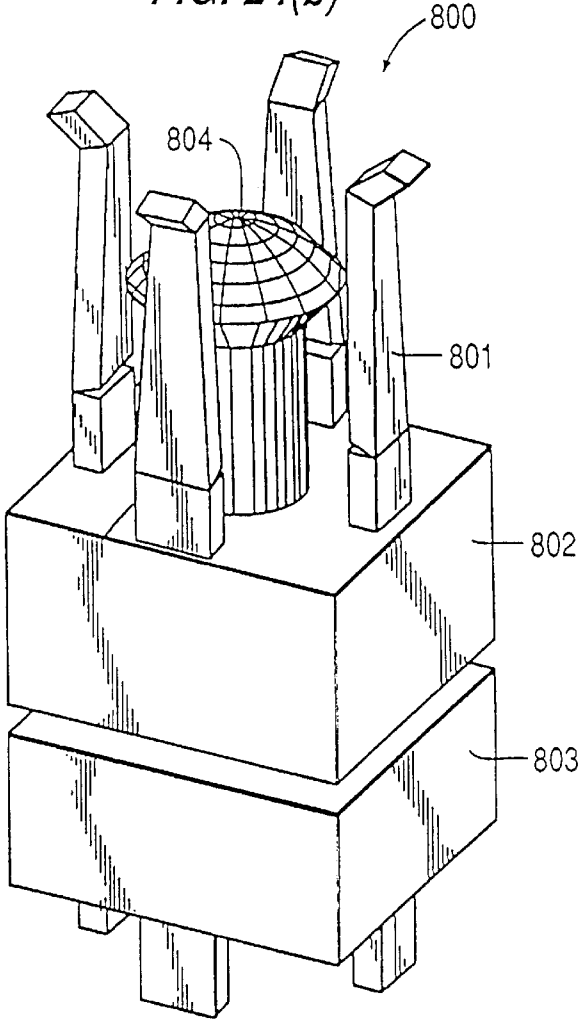
FIG. 24(*a*) is a perspective view of a second type of zero-insertion force component in a first state.
Figure 24A:
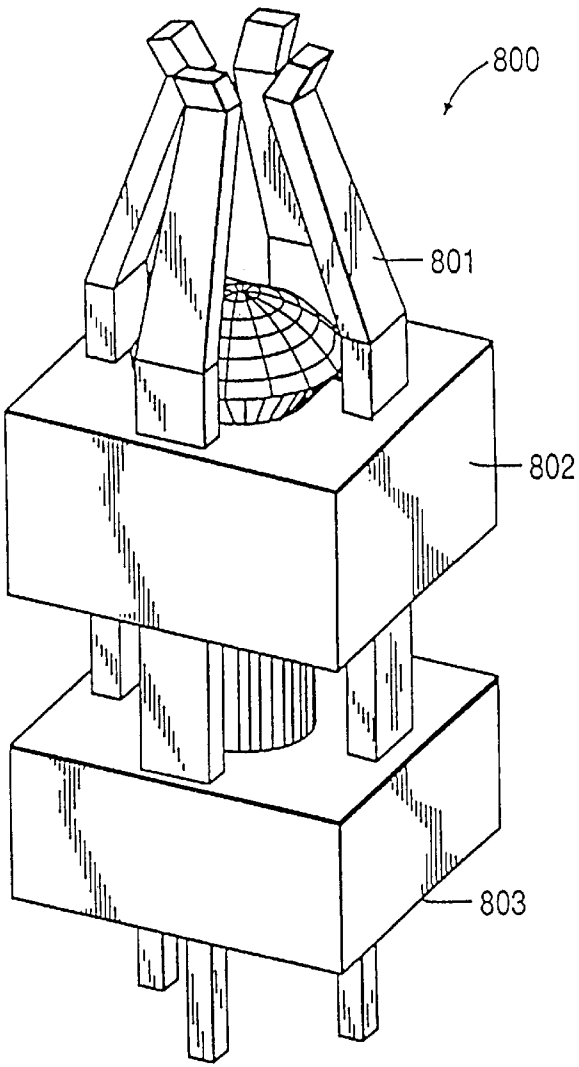

With reference to FIG. 24, zero-insertion force interconnect component 800 includes a plurality (e.g. four) of conductive beams 801 supported by an insulative substrate 802. Further, the interconnect component 800 includes a movable substrate 803 and a bulbous member 804 fixed to the movable substrate. The movable substrate may be manually operated, or operated by machine. Also, the bulbous member may be replaced by a straight member with no bulb.

The zero-insertion force interconnect component of FIG. 24 is essentially the same as the component shown in FIG. 23 except that the movable substrate is located below the fixed substrate and the fixed substrate includes an aperture to allow movement of the bulbous member within that surface.

FIG. 24(*a*) shows the initial state of the interconnect component 800. Prior to mating the interconnect component 800 with a projection-type interconnect component, the movable block 803 is moved upward as depicted in FIG. 24(*b*) causing member 804 to spread apart the conductive beams 801. By spreading the conductive beams 801 prior to mating, the insertion force normally associated with the insertion of the projection-type interconnect component is essentially eliminated. The bulbous member 804 moves back into its original position in response to insertion of the projection-type interconnect component or under the control of a separate mechanical device such as a cam, thereby releasing the beams of the receiving-type interconnect component.

Figure 25B:
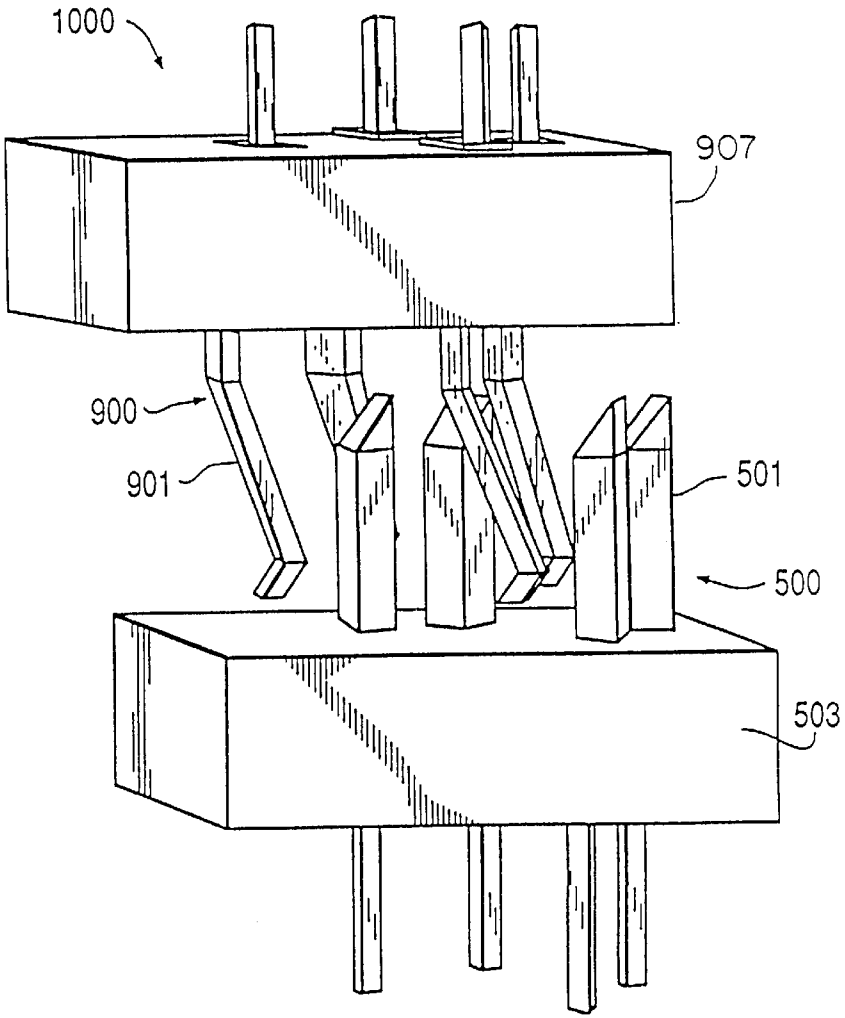
FIG. 25(*a*) is a perspective view of a third type of zero-insertion force component in a first state.
Figure 25A:
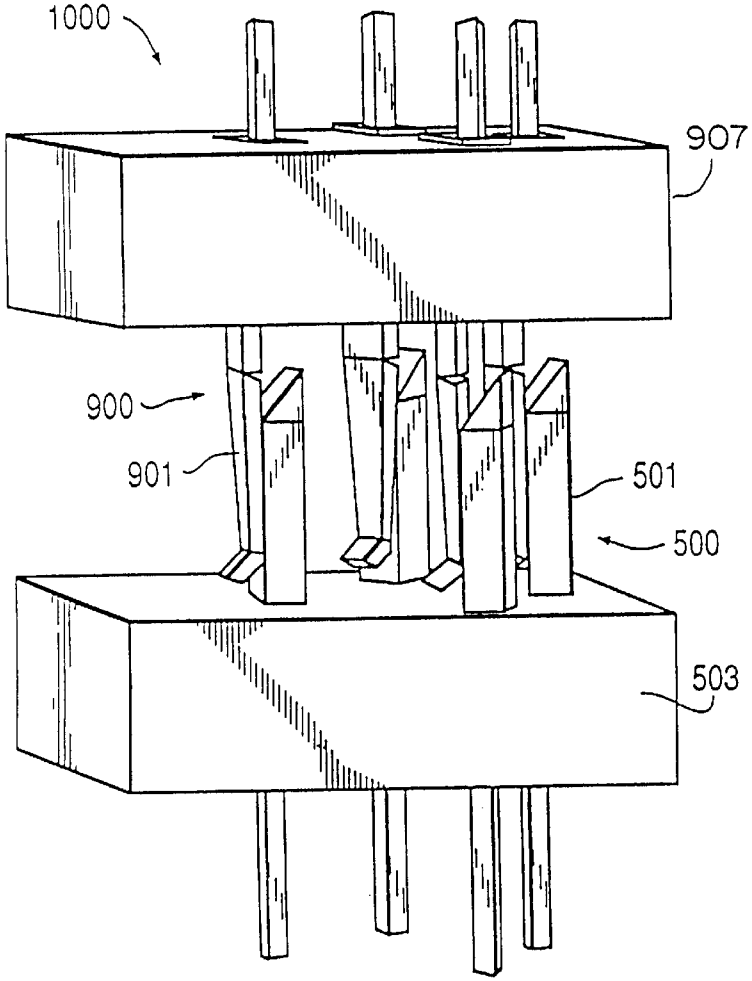

FIGS. 25(*a*) and 25(*b*) (collectively referred to herein as "FIG. 25") show a third type of zero-insertion force interconnect system 1000 in accordance with the present invention. In the system of FIG. 25, the projection-type interconnect component 500 includes several (e.g., three) conductive posts 501 attached to an insulative substrate 503, and the receiving-type component 900 includes several (e.g., three) conductive beams 901 attached to another insulative substrate 907. The leftward post 501 in FIGS. 25(*a*) and 25(*b*) is from a projection-type interconnect component other than the projection-type interconnect component associated with the remaining posts shown in FIGS. 25(*a*) and 25(*b*). Similarly, the leftward beam 901 in FIGS. 25(*a*) and 25(*b*) is from a receiving-type interconnect component other than the receiving-type interconnect component associated with the remaining beams shown in FIGS. 25(*a*) and 25(*b*).

FIG. 25(*b*) shows the interconnect system during the mating process, and FIG. 25(*a*) shows the interconnect system in the mated condition. Mating through use of the system of FIG. 25 is performed as follows. First, substrate 503 and substrate 907 are moved toward one another until the condition shown in FIG. 25(*b*) is achieved. Next, the substrates 503 and 907 are moved parallel to one another (for example, by a cam or other mechanical device) until the contact portions of the posts 501 and the contact portions of the beams 901 contact or mate, as shown in FIG. 25(*a*). Essentially no insertion force is required to achieve the condition shown in FIG. 25(*a*) because the posts 501 and beams 901 do not contact one another until after the condition shown in FIG. 25(*a*) is achieved.

Figure 26A:
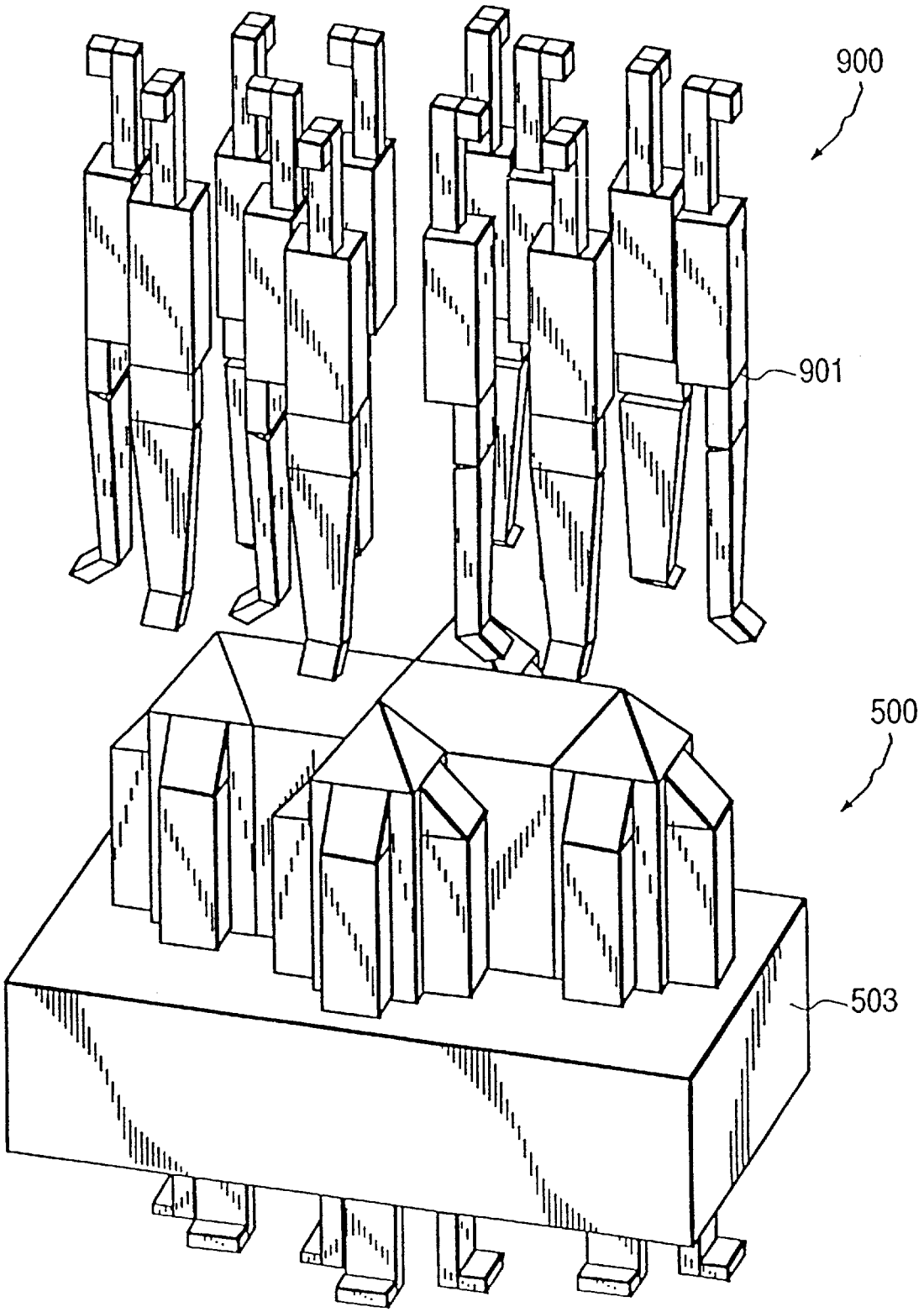
FIG. 26(*a*) is a perspective view of an interconnect system including the interconnect component of FIG. 12 in a position prior to mating, with the beams shown in an open state.
Figure 26B:
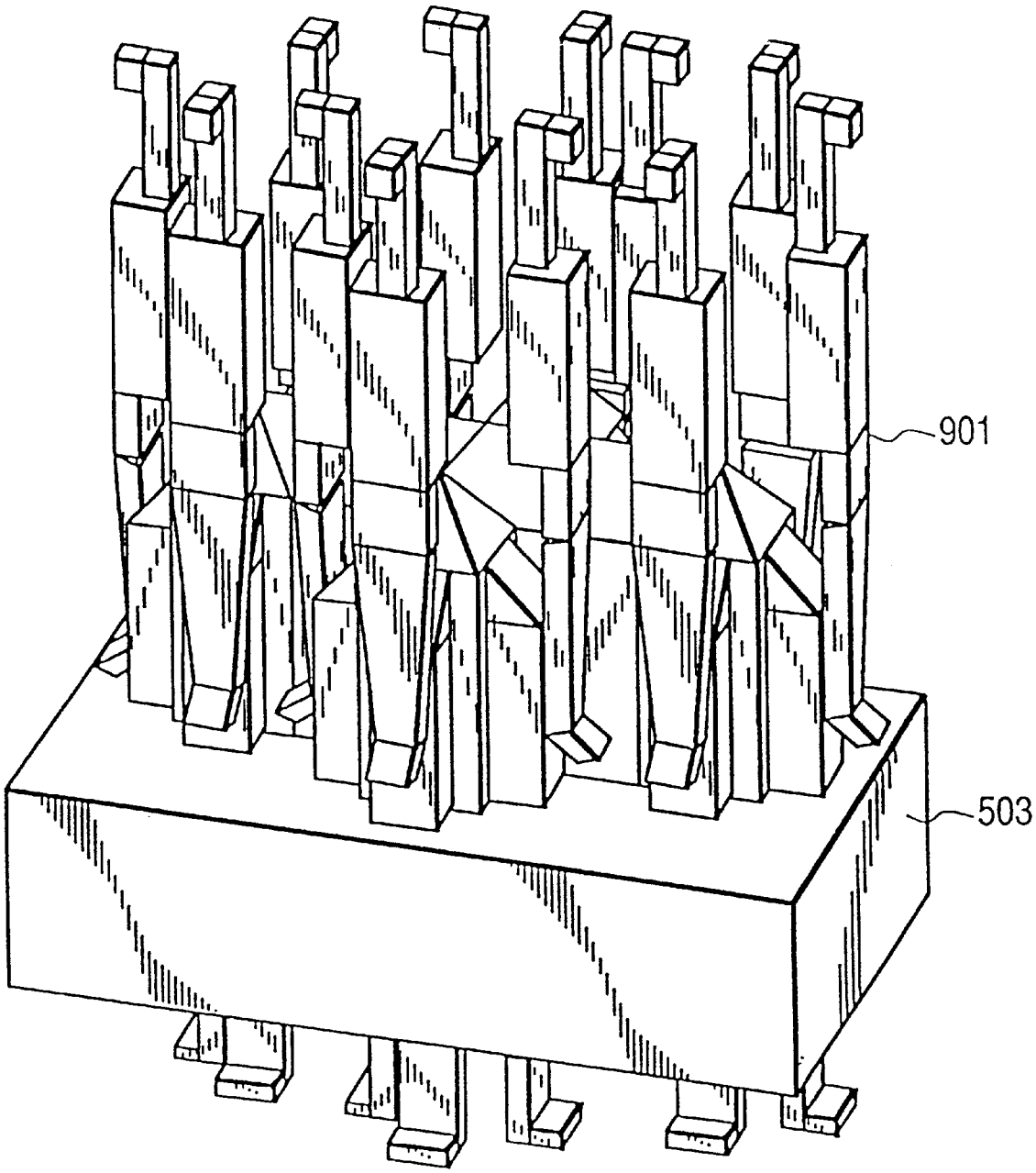

FIGS. 26(*a*) and 26(*b*) illustrate the mating of the cross-shaped projection-type interconnect component of FIG. 12 within a corresponding receiving-type interconnect component 900. The receiving-type interconnect component 900 of FIGS. 26(*a*) and 26(*b*) includes, for example, twelve conductive beams 901 for mating with the conductive posts of the projection-type interconnect component. FIG. 26(*a*) shows the interconnect system prior to mating (but with the beams 901 in the open condition), and FIG. 26(*b*) shows the interconnect system in the mated condition.

Figure 27A:
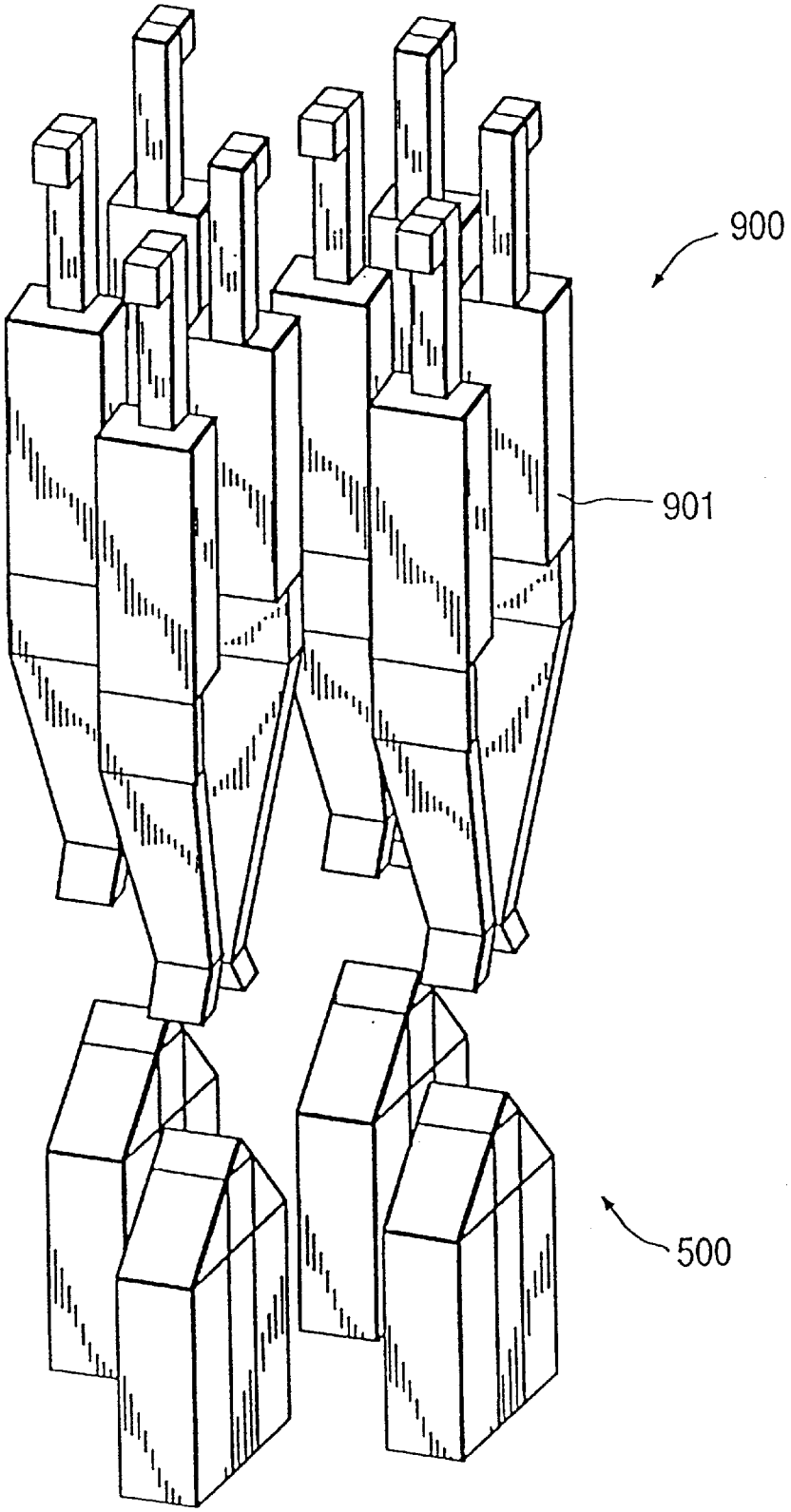
FIG. 27(*a*) is a perspective view of an interconnect system including the interconnect component of FIG. 13(*a*) in a position prior to mating.
Figure 27B:
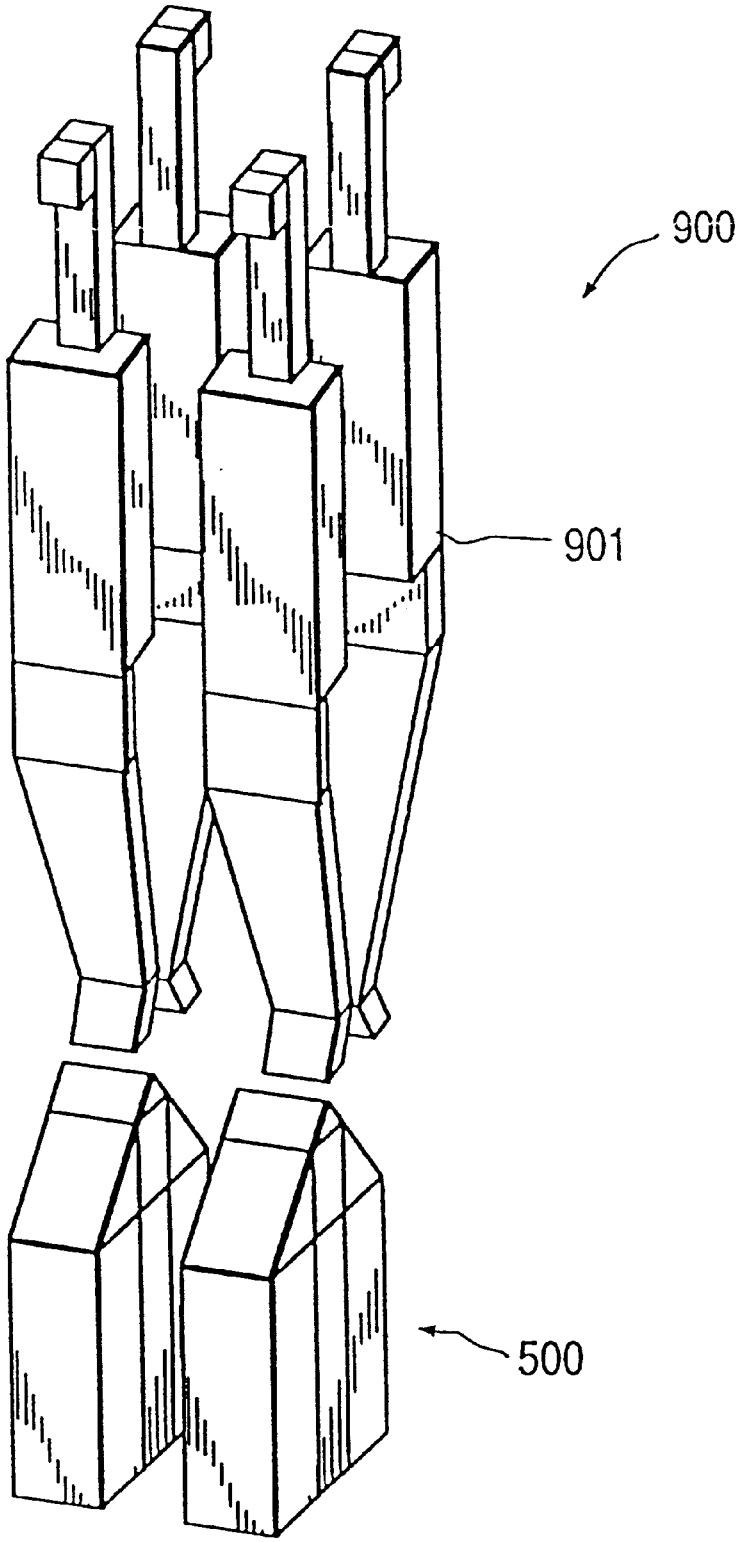

FIGS. 27(*a*) and 27(*b*) illustrate the mating of at least one projection-type interconnect component 500 of FIG. 13(*a*) within a corresponding receiving-type interconnect component 900. Each receiving-type interconnect component 900 of FIGS. 27(*a*) and 27(*b*) includes two conductive beams 901 for mating with the two conductive posts of the projection-type interconnect component. FIG. 27(*b*) shows the interconnect system wherein the projection-type interconnect components are located side-by-side, and FIG. 27(*a*) shows the interconnect system wherein the projection-type interconnect components are arranged in a diamond-shaped or offset configuration.

E. The Insulative Substrate

As explained above, the conducive posts of the projection-type interconnect component are attached to an insulative substrate 503. Likewise, the conductive beams of the receiving-type component are attached to an insulative substrate 907.

Figure 28A:
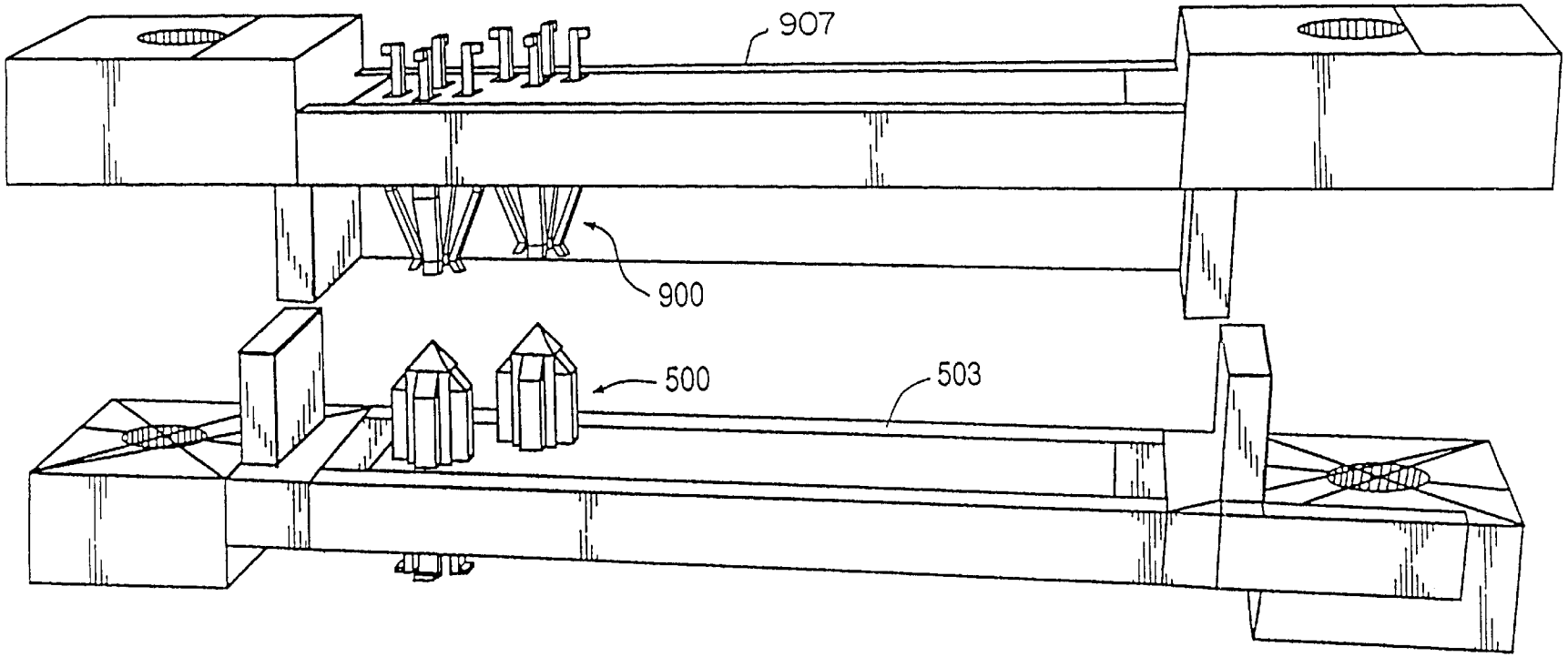
FIG. 28(*a*) is a perspective view of an electrical interconnect system showing insulative electrical carriers functioning as the substrates for the system.
Figure 28B:
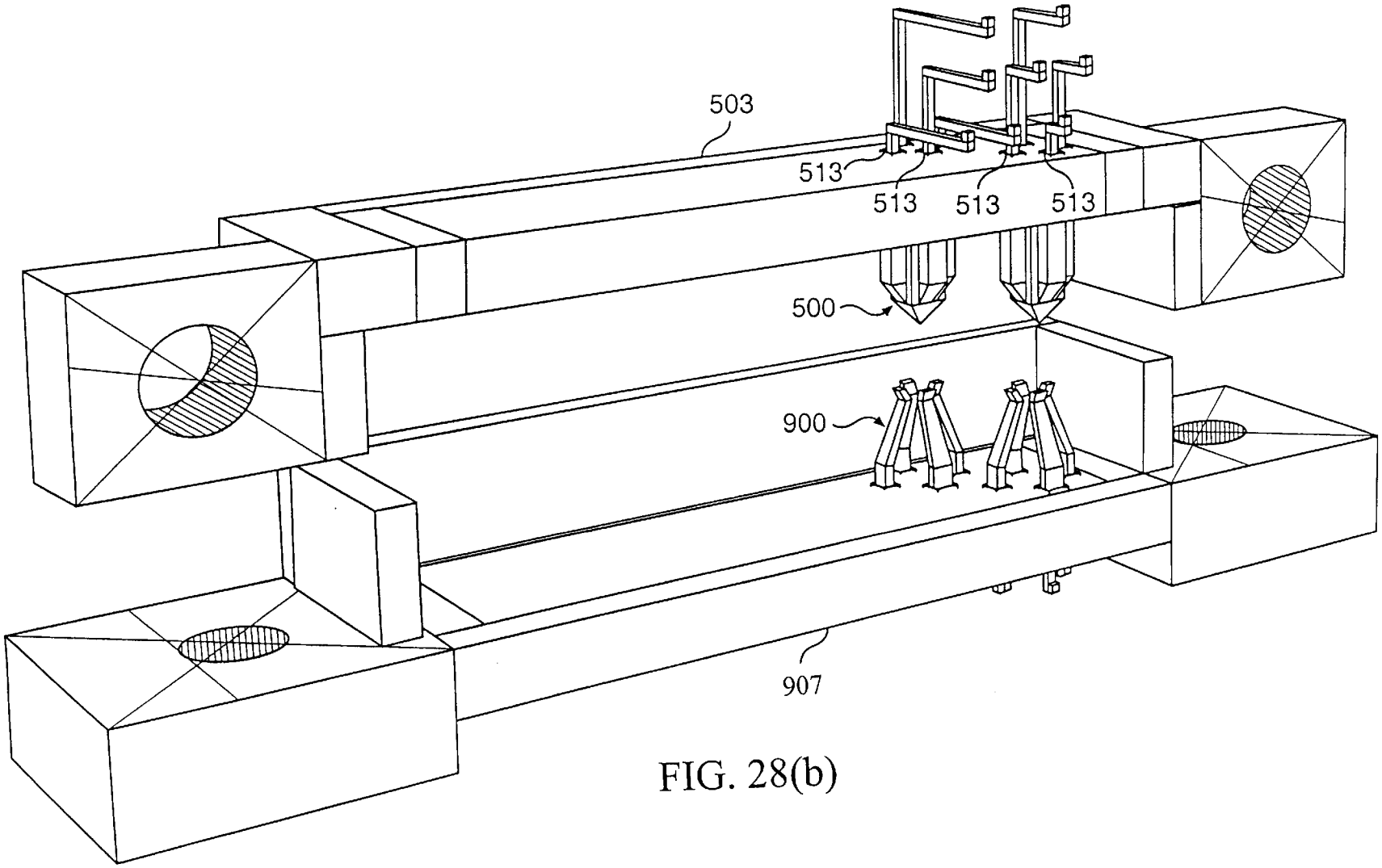

FIGS. 28(*a*) and 28(*b*) (referred to collectively herein as "FIG. 28") show an insulative electrical carrier functioning as the substrate 503 for the projection-type interconnect component 500 and an insulative electrical carrier functioning as the substrate 907 for the receiving-type interconnect component 900. The carrier 503 in FIG. 28(*b*) is arranged so that a right angle connection may be made using the foot portions of projection-type interconnect component 500. The carrier 907 in FIG. 28(*b*), as well as the carriers in FIG. 28(*a*), are arranged for straight rather than right angle connections.

When used for surface mounting to a printed wire board, for example, the foot portion of mac post and/or beam being surface mounted should extend beyond the furthest extending portion of the substrate by approximately 0.3 mm. This compensates for inconsistencies on the printed wiring board, and makes the electrical interconnect system more flexible and compliant.

The connectors of FIG. 28 are polarized so that the chance of backward mating is eliminated. Keying is another option which can differentiate two connectors having the same contact count.

F. The Interconnect Arrangement

The present invention holds a distinct advantage over prior art electrical interconnect systems because the interconnect components of the present invention can be arranged in a nested configuration far more dense than typical pin grid arrays (PGAs) or edge connectors. Such a configuration is not contemplated by existing prior art electrical interconnect systems.

Figure 29:
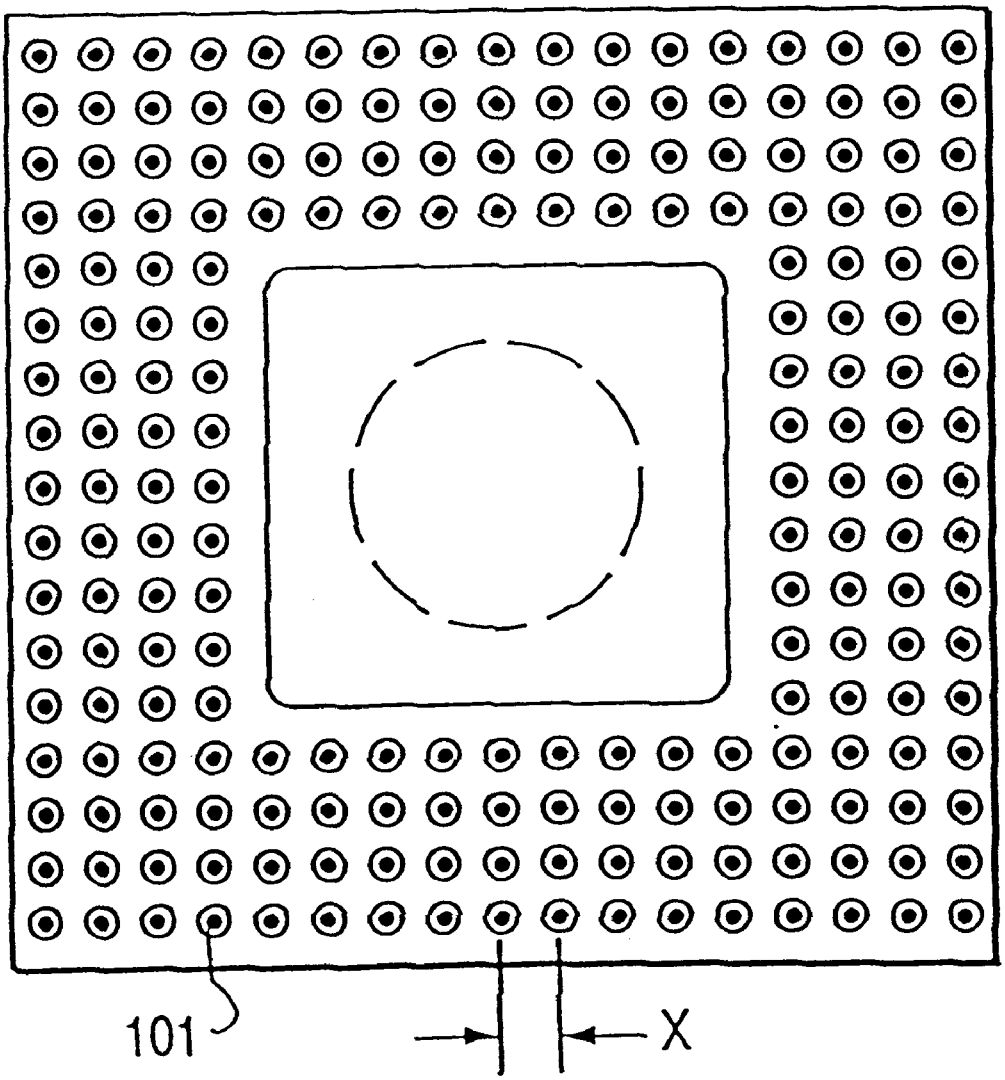
FIG. 29 PRIOR ART
FIG. 29 is a top view of a prior art pin grid array.

A prior art pin grid array is shown in FIG. 29. In a typical prior art pin grid array, several rows of post-type interconnect components 101 are positioned on a support surface. All of the posts 101 of the pin grid array within a given row or column are separated from one another by a distance X. In the pin grid array of FIG. 29, the minimum distance that X may be is approximately 2.5 mm. However, the distance X may be as low as 1.25 mm when only two rows of posts are used.

The present invention is capable of providing much higher densities. Instead of using a grid or rows of individual posts for connecting to respective individual sockets, the electrical interconnect system of the present invention arranges a plurality of contacts (e.g., conductive posts) into groups, and then interleaves the groups among one another for receipt of each group within a respective receiving-type interconnect component. Thus, while prior art interconnect systems function by interconnecting individual pins with individual sockets, the present invention increases density and flexibility by interconnecting whole groups of posts with individual receiving-type interconnect components in the most efficient manner possible.

Figure 30:
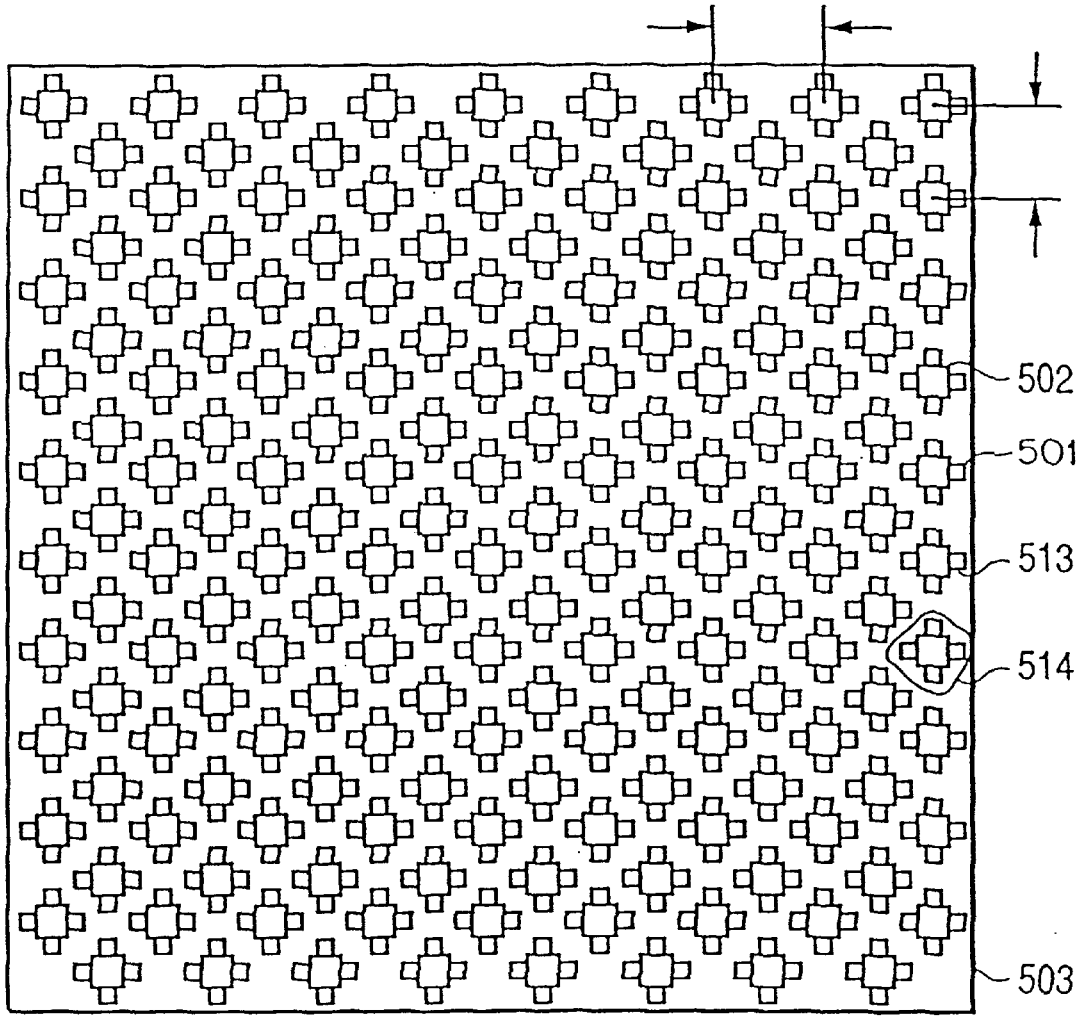
FIG. 30 is a top view of an interconnect arrangement in accordance with the present invention.

In the present invention, several groups of holes 513 are formed in an insulated substrate 503 (FIG. 30). Each group 514 is configured so that when conductive posts are fitted within the holes, all of the posts of that group may be received within a single receiving-type interconnect component (e.g., the receiving-type interconnect component shown in FIG. 14). Furthermore, the posts 501 of each group are arranged in a configuration such that each group may be interleaved or nested within other ones of the groups. In other words, the posts 501 of each group 514 are arranged so that portions of each group overlap into columns and rows of adjacent groups of posts to achieve the highest possible density while providing adequate clearance for the mating beams 901 of the receiving-type interconnect components. It should be noted that while each group 514 of FIG. 30 may have a buttress 502 located at a central portion of that group, either in contact with posts 501 or not in contact with the posts, one or more (e.g., all) of the groups may be without a buttress.

As shown in FIG. 30, each group 514 may be formed in the shape of a cross. However, other shapes (such as would result from the components illustrated in FIGS. 12, 13(*a*), 13(*c*), or 25, or other shapes that may be easily nested) are contemplated. The grouping of posts 501 into the shape of a cross (as in FIG. 30) aids in balancing beam stresses to keep the conductive beams 901 of each receiving-type interconnect component from being overly stressed. Further, the use of cross-shaped groups results in alignment advantages not found in prior art systems such as the pin grid array of FIG. 29. For example, the cross-shaped groups of FIG. 30 each align with beams 901 of a receiving-type interconnect component 900, causing the whole arrangement of FIG. 30 to be similarly aligned.

The nesting of groups (e.g., cross-shaped groups) of holes or posts allows adequate clearance between the posts for receipt within the receiving-type interconnect components, while decreasing to a minimum the space between the posts. No prior art system known to the inventor utilizes space in this manner. Furthermore, as explained above, the inclusion of a buttress between the posts 501 of each group 514 is optional. In the absence of a buttress, each group of posts 501 is capable of spreading corresponding conductive beams of the receiving-type interconnect component during mating due to the sloped upper surfaces of the posts.

It should be noted that the nested configuration (an example of which is shown in FIG. 30) eliminates the need for providing insulative walls between the posts 501, although such insulative walls may be used if desired. Further, by arranging the posts 501 into groups (e.g., the cross-shaped groups 514 of FIG. 30), the foot portions of the projection-type and receiving-type interconnect components for each group may be arranged to enhance the layout and trace routing of the interface devices (e.g., printed wire boards) being interconnected.

Figure 31:
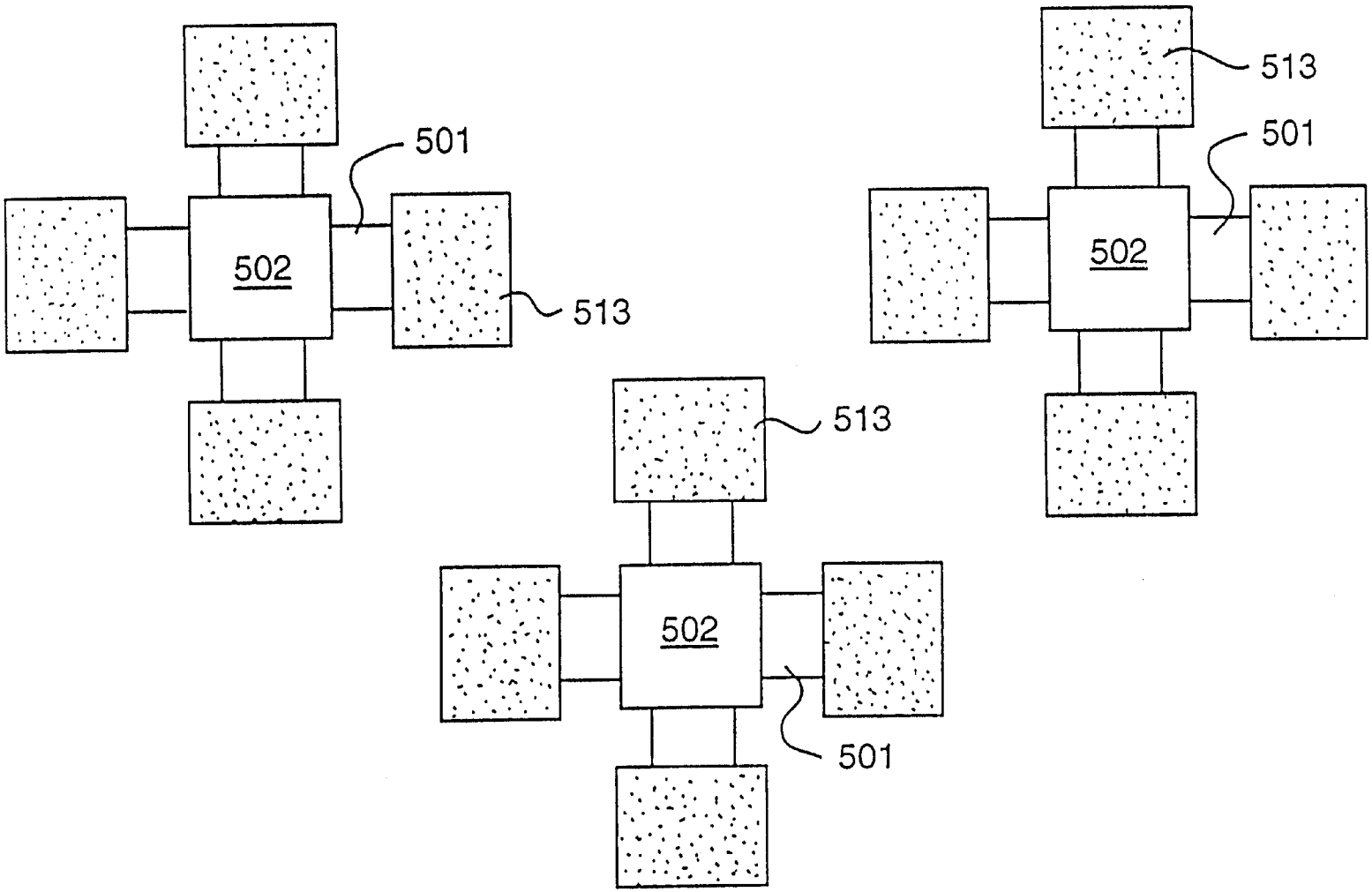
FIG. 31 is a top view of a portion of an interconnect arrangement in accordance with the present invention.

The density of the interconnect arrangement of FIG. 30, as can be understood from the dimensions printed on that Figure, is over 600 contacts per square inch, although this density can be adjusted by varying the configuration of the posts and beams, the spacing between buttresses, and the size of the buttresses used. As explained previously, the cross-section of each buttress may be 0.9 mm by 0.9 mm, 0.5 mm by 0.5 mm, or some other dimension. An arrangement wherein each buttress is 0.5 mm by 0.5 mm is shown in FIG. 31. Even higher densities may be achieved when a buttress is not used.

Conductive posts 501, discussed previously, fit within the holes 513 of the interconnect arrangement shown in FIG. 30, and connect to corresponding beams 901, discussed previously, of a receiving-type interconnect component. The separate contract, stabilizing, and foot portions of the conductive posts and beams operate to maximize the effectiveness of the interconnect arrangement.

For example, as shown in FIG. 7, the contact portion 507 of each conductive post 501 may be offset in the direction of the buttress. By offsetting the contact portion in this fashion, a smaller buttress may be used, or the buttress may be eliminated entirely. Accordingly, the density of the electrical interconnect arrangement shown in FIG. 30 will be increased using an offset post such as shown in FIG. 7.

Figure 32:
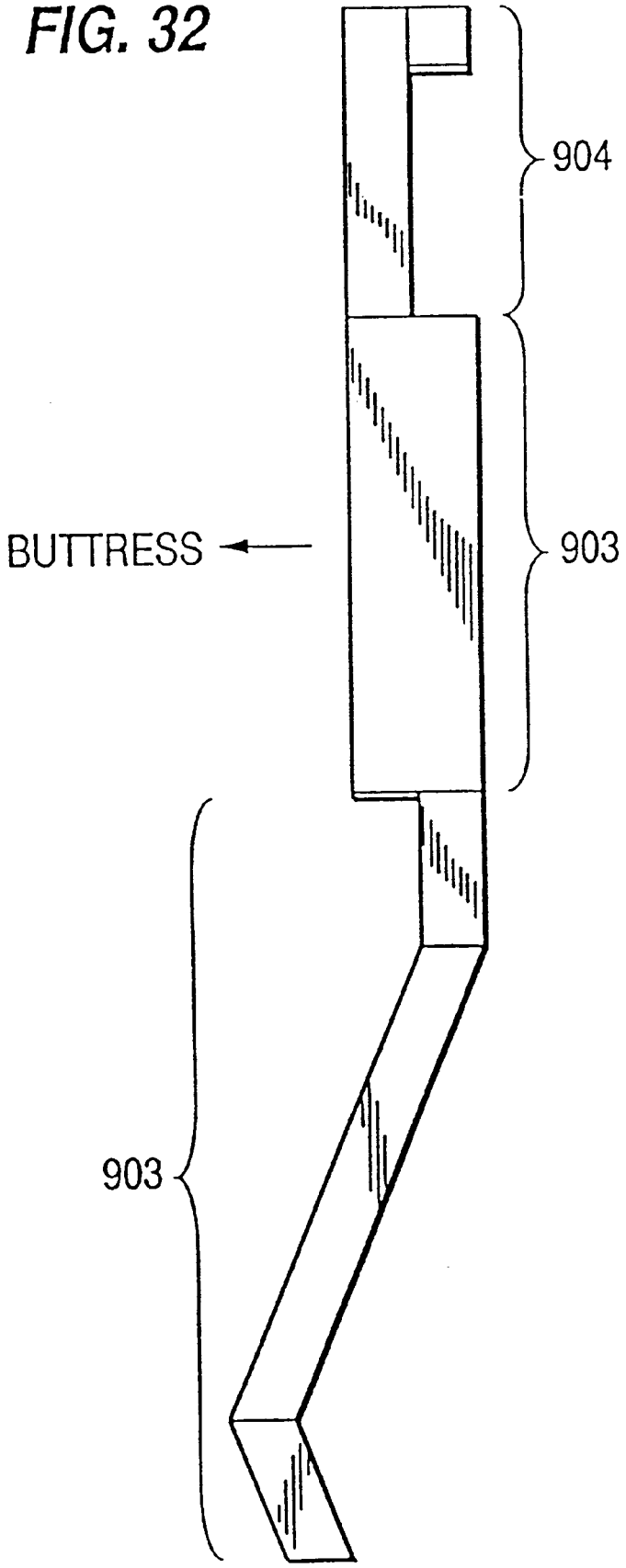
FIG. 32 is a side view of a conductive beam having an offset contact portion.

When an offset type post (e.g., as in FIG. 7) is used, the contact portion of the corresponding conductive beam may also be offset. However, as shown in FIG. 32, the contact portion 902 of the conductive beam 901 is generally offset away from the buttress to decrease the amount of stress exerted on the conductive beam and to minimize space used. Through use of the offset post 501 of FIG. 7 in connection with the offset beam 901 of FIG. 32, higher electrical interconnect densities may be achieved.

Figure 33A:
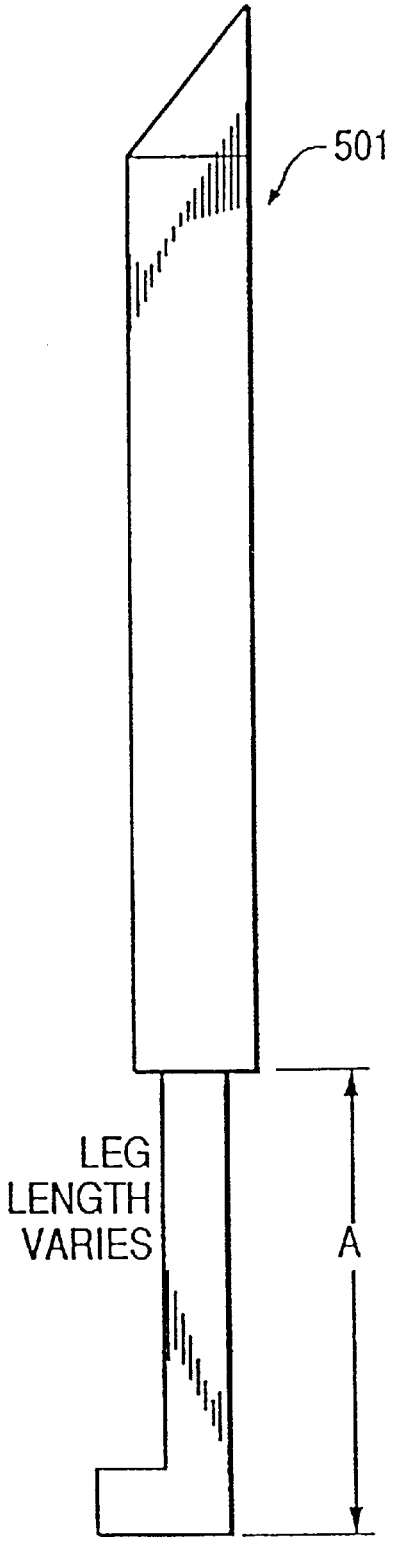
FIG. 33(*a*) is a side view of a conductive post having aligned stabilizing and foot portions.
Figure 33B:
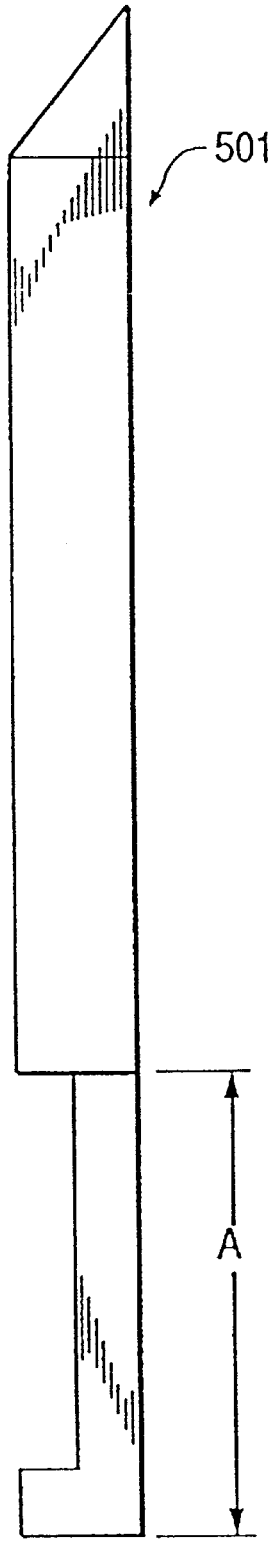

Like the contact portion, the foot portion of a conductive post 501 or conductive beam 901 may be aligned with or offset from its corresponding stabilizing portion. FIG. 33(*a*) shows a conductive post 501 having a foot portion 509 aligned about the central axis of the stabilizing portion, while FIG. 33(*b*) shows a conductive post 501 having a foot portion 509 offset from its stabilizing portion. The alignment and offset shown in FIGS. 33(*a*) and 33(*b*), respectively, are equally applicable to each conductive beam 901.

The configuration of FIG. 33(*a*) is used, for example, when the substrate 503 is arranged perpendicularly with respect to the device with which the foot portion 509 is interfacing. The configuration of FIG. 33(*b*), on the other hand, may be used when a straight interconnect is being made between a foot portion and the interface device, and there is little room on the interface device for making a connection to the foot. It should be noted that the foot portion of a post may be aligned or offset with its corresponding stabilizing portion to fit within a foot interface pattern normally associated with a beam, or the foot portion of a beam may be aligned or offset with its corresponding stabilizing portion to fit within a foot interface pattern normally associated with a post.

Other advantages result form the use of a post 501 and/or beam 901 including separate contact, stabilizing, and foot portions, and configurations of such portions other than those discussed above are contemplated. For example, the contact portion of a post or beam may be the same size as the stabilizing portion of that post or beam as in FIG. 8 for ease of manufacturing, or the contact portion may be smaller (i.e., narrower) than the stabilizing portion as in FIG. 6 to increase the density of the interconnect system.

In the situation where the contact portion is made narrower than its corresponding stabilizing portion, the hole (e.g., hole 513 of FIG. 30) in which the post or beam is secured may be configured to have a different width or diameter at different levels. For example, the width or diameter near the portion of the hole through which the contact portion protrudes may be narrower than the width or diameter at the other side of the substrate through which the foot portion protrudes. In this type of configuration, the post or beam is inserted into the hole with the contact portion entering first, and then pushed further into the hole until the shoulder of the stabilizing portion abuts the section of the hole having the narrower width or diameter. By configuring the hole in this manner, over-insertion (i.e., insertion of the post or beam to the extent that the stabilizing portion extends through the hole) may be prevented.

Like the contact portion, the foot portion of each post or beam may be the same size as the stabilizing portion of that post or beam, or the foot portion may be smaller (i.e., narrower) than the stabilizing portion to interface with high density interface devices and/or provide circuit design and routing flexibility. In the situation where the foot portion is made narrower than its corresponding stabilizing portion, the hole (e.g., hole 513 of FIG. 30) in which the post or beam is secured may be configured to have a different width or diameter at different levels. For example, the width or diameter near the portion of the hole through which the foot portion protrudes may be narrower than the width or diameter at the other side of the substrate through which the contact portion protrudes. In this type of configuration, the post or beam is inserted into the hole with the foot portion entering first, and then pushed further into the hole until the shoulder of the stabilizing portion abuts the section of the hole having the narrower width or diameter. By configuring the hole in this manner, over-insertion (i.e., insertion of the post or beam to the extent that the stabilizing portion extends through the hole) may be prevented.

It should be noted that when the contract portion of a post or beam is offset from the stabilizing portion (for example, as shown in FIG. 7), the post or beam must be inserted into the corresponding hole with the foot portion entering first. Similarly, when the foot portion of a post or beam is offset from the stabilizing portion, the post or beam must be inserted into the corresponding hole with the contact portion entering first.

The foot portion of each post or beam may be arranged in many different configurations. For example, the foot portion may have its central axis aligned with the central axis of the stabilizing portion, as in FIG. 33(*a*). Alternatively, the foot portion may be offset from the stabilizing portion so that a side of the foot portion is coplanar with a side of the stabilizing portion, as shown in FIG. 33(*b*).

Also, the foot portion of each post or beam may be attached to different portions of the stabilizing portion. For example, the foot portion may be attached to the middle, corner, or side of a stabilizing portion to allow trace routing and circuit design flexibility, and increased interface device density.

Further variations of the foot portion of each post or beam are contemplated. Within a given projection-type or receiving-type interconnect component, the foot portions of that component can be configured to face toward or away from one another, or certain foot portions may face toward one another while other ones of the foot portions face away from one another. Likewise, the foot portions of a given interconnect component may be arranged so that each foot portion faces the foot portion to its immediate left, or so that each foot portion faces the foot portion to its immediate right.

Also, a secondary molding operation could be used to bind the foot portions of one or more interconnect components together. In this type of configuration, an insulative yoke or substrate could be formed around the foot portions just above the point at which the foot portions connect to the interface device to hold the foot portions in place, to aid in alignment, and to protect the foot portions during shipping.

Additionally, portions of the foot portions of the posts and/or beams may be selectively covered with insulative material to prevent shorting and to allow closer placement of the foot portions with respect to one another (e.g., the placement of the foot portions up against one another). This type of selective insulating is especially applicable to right angle connections such as shown in FIG. 11(*a*). With reference to FIG. 11(*b*), such selective insulation of the foot portions can be used to allow closer placement of all of the foot portions within each component to one another. Alternatively, such selective insulation can be used to allow closer placement of only the foot portions within each component that share the same row (e.g., rows C, D, and E of FIG. 11(*b*)) to one another. Although the selective insulation of the foot portions helps to prevent shorting when these types of closer placements are made, such closer placements may be made in the absence of the selective insulation.

As can be seen from the foregoing description, the use of posts and beams which include separate contact, stabilizing, and foot portions maximizes the efficiency and effectiveness of the interconnect arrangement of the present invention. Further, the selective structure of the conductive posts and beams allows flexibility in circuit design and signal routing not possible through the use of existing interconnect systems.

G. Manufacturing

The conductive posts of the projection-type interconnect component and the conducive beams of the receiving-type interconnect component may be stamped from strips or from drawn wire, and are designed to ensure that the contact and interface portions face in the proper direction in accordance with the description of the posts and beams above. Both methods allow for selective plating and automated insertion. The foot portions in the right angle embodiments protrude from the center of the stabilizing section, thereby allowing one pin die with different tail lengths to supply contacts for all sides and levels of the electrical interconnect system of the present invention. However, for maximum density, the foot portions may be moved away from the center of the stabilizing portion to allow maximum density while avoiding interference between adjacent foot portions.

The stamped contacts can be either loose or on a strip since the asymmetrical shape lends itself to consistent orientation in automated assembly equipment. Strips can either be between stabilizing areas or form a part of a bandolier which retains individual contacts. The different length tails on the right angle versions assist with orientation and vibratory bowl feeding during automated assembly. The present invention is compatible with both stitching and gang insertion assembly equipment. The insulative connector bodies and packaging have been designed to facilitate automatic and robotic insertion onto printed circuit boards or in termination of wire to connector.

H. Conclusion

The present invention provides an electrical interconnect system that is higher in density, faster, less costly, and more efficient than existing high-density electrical interconnect systems. Accordingly, the present invention is capable of keeping pace with the rapid advances that are currently taking place in the semiconductor and computer technologies.

It will be apparent to those skilled in the art that various modifications and variations can be made in the disclosed electrical interconnect system without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An electrical connector comprising:

a projection-type interconnect component including an insulative buttress and a plurality of electrically conductive contacts, said contacts spaced from each other around a circumference of the insulative buttress; and a receiving-type interconnect component for receiving said projection-type interconnect component, said receiving-type interconnect component including a substrate, a plurality of flexible, electrically conductive contacts held in said substrate, and a movable spacer having a plurality of holes formed therethrough through which said flexible contacts move, wherein said spacer at least partially flexes said flexible contacts when said spacer is in a first position.

2. An electrical connector according to claim 1, wherein projection-type interconnect component includes four contacts, each of four contacts extending axially along said insulative buttress and spaced apart around the circumference of said buttress.

3. An electrical connector according to claim 1, wherein said contacts of said projection-type interconnect component are substantially rigid.

4. An electrical connector according to claim 1, wherein said spacer comprises a bulb for at least partially flexing said flexible contacts.

5. An electrical connector according to claim 1, wherein said receiving-type interconnect component further comprises a movable substrate movable relative to said substrate and said flexible contacts, wherein said spacer is fixed to said movable substrate.

6. An electrical connector according to claim 1, wherein said spacer flexes each of said flexible contacts in a different direction.

7. An electrical connector according to claim 1, wherein said spacer, when moved to a second position, does not substantially flex said flexible contacts.

8. An electrical connector according to claim 1, wherein said flexible contacts engage an outer periphery of said spacer when said spacer is in the first position.

9. An electrical connector according to claim 1, wherein said spacer, when in the first position, flexes said flexible contacts outwardly away from a center portion of said spacer.

10. An electrical connector according to claim 1, wherein said spacer, when in the first position, reduces the insertion force required for the receiving-type interconnect component to receive the projection-type interconnect component.

11. An electrical connector according to claim 1, wherein said substrate includes a hole through which said spacer moves.

12. An electrical connector according to claim 5, wherein the portions of said flexible contacts that flex when said spacer is in said first position are disposed nearer to said movable substrate than to said substrate.

13. An electrical connector according to claim 12, wherein said movable substrate is disposed between the flexible contact portions and said substrate.

14. An electrical connector comprising:

a projection-type interconnect component including an insulative buttress and a plurality of electrically conductive contacts, the contacts spaced from each other around a circumference of the insulative buttress; and a receiving-type interconnect component for receiving said projection-type interconnect component, said receiving-type interconnect component including a substrate, a plurality of flexible, electrically conductive contacts held spaced from each other in said substrate, and a movable spacer having holes through which said contacts are received, said spacer being movable relative to the flexible contacts and the substrate to a first position at which the spacer flexes said contacts and a second position at which the spacer does not flex said contacts, and wherein the insulative buttress of said projection-type interconnect component displaces the spacer from the first position to the second position when said projection-type interconnect component is received by said receiving-type interconnect component.

15. An electrical connector according to claim 14, wherein projection-type interconnect component includes four substantially rigid contacts, each of said four contacts extending axially along said insulative buttress and spaced apart around the circumference of said buttress.

16. An electrical connector according to claim 14, wherein said spacer comprises a bulb for at least partially flexing said flexible contacts.

17. An electrical connector according to claim 14, wherein said receiving-type interconnect component further comprises a movable substrate movable relative to said substrate and said flexible contacts, wherein said spacer is fixed to said movable substrate.

18. An electrical connector according to claim 14, wherein said spacer flexes each of said flexible contacts in a different direction.

19. An electrical connector according to claim 14, wherein said spacer, when in the first position, reduces the insertion force required for the receiving-type interconnect component to receive the projection-type interconnect component.

20. An electrical connector according to claim 14, wherein said flexible contacts of said receiving-type interconnect component flexibly contact said contacts of said projection-type interconnect component when the insulative buttress of said projection-type interconnect component displaces the spacer.

21. An electrical connector according to claim 14, wherein said substrate has a hole through which said spacer is received.

22. An electrical connector according to claim 17, wherein portions of said flexible contacts that flex when said spacer is in said first position are disposed nearer to said movable substrate than to said substrate.

23. An electrical connector according to claim 18, wherein said movable substrate is disposed between said flexible contact portions and said substrate.

* * * * *